US008246491B2

(12) United States Patent
Wood et al.

(10) Patent No.: US 8,246,491 B2
(45) Date of Patent: Aug. 21, 2012

(54) GOLF TEE AND METHODS TO MANUFACTURE GOLF TEES

(75) Inventors: Paul D. Wood, Phoenix, AZ (US); Gregory J. Swartz, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 12/837,357

(22) Filed: Jul. 15, 2010

(65) Prior Publication Data

US 2010/0279798 A1 Nov. 4, 2010

Related U.S. Application Data

(62) Division of application No. 12/014,466, filed on Jan. 15, 2008, now Pat. No. 7,780,551.

(51) Int. Cl.
*A63B 57/00* (2006.01)

(52) U.S. Cl. ..... 473/396; 473/401

(58) Field of Classification Search ..... 473/387–403
See application file for complete search history.

(56) References Cited

U.S. PATENT DOCUMENTS

| | | | | |
|---|---|---|---|---|
| 2,011,203 | A * | 8/1935 | Seiki | 473/396 |
| 2,839,304 | A * | 6/1958 | Lerick | 473/397 |
| 3,079,158 | A * | 2/1963 | Finn et al. | 473/396 |
| 3,645,537 | A * | 2/1972 | Parenteau | 473/396 |
| 4,516,780 | A * | 5/1985 | Tabet | 473/398 |
| 4,524,974 | A * | 6/1985 | Matsuura | 473/396 |
| 4,989,869 | A * | 2/1991 | Lackey | 473/396 |
| 6,783,470 | B2 * | 8/2004 | Lee | 473/401 |
| 7,086,972 | B2 * | 8/2006 | Bainbridge et al. | 473/386 |
| 7,344,456 | B2 * | 3/2008 | Hayton | 473/396 |
| 7,494,429 | B2 * | 2/2009 | Lee | 473/396 |

* cited by examiner

*Primary Examiner* — Steven Wong

(57) ABSTRACT

Embodiments of golf tees, such as golf tees with compressible materials, are described herein. Other examples and related methods are also described herein.

34 Claims, 18 Drawing Sheets

4000

100
PLANE
1212
19000
19210
19200
19221
19222
19220
19223
19700
19800
19224
19123
19225
19121
19122
19120
19900
19500
19400
19100
19110

21000
100
PLANE
1212
21210
21200
21222
21221
21800
21900
21124
21220
21123
21226
21224
21223
21700
21121
21225
21400
21122
21500
21120
21100
21110

23000

25000

28000

GOLF TEE AND METHODS TO MANUFACTURE GOLF TEES

CROSS-REFERENCE TO RELATED APPLICATION

This patent application is a divisional patent application claiming priority to U.S. patent application Ser. No. 12/014,466, filed on Jan. 15, 2008 now U.S. Pat. No. 7,780,551. The disclosure of the referenced application is incorporated herein by reference.

TECHNICAL FIELD

This disclosure relates generally to golf equipment, and relates more particularly to golf tees and methods of manufacturing and operating golf tees.

BACKGROUND

When hitting a golf ball with a golf club off a golf tee, resistance from the golf tee can have a measurable effect on, for example, a spin rate and/or a launch angle imparted by the golf club to the golf ball. In some cases, this may increase the spin rate of the golf ball at it leaves the golf tee, and can cause a flight trajectory of the golf ball to be higher than desired, and/or a travel distance of the golf ball to be shorter than desired. Minimizing resistance from the golf tee to the golf ball can be beneficial to achieving the intended flight trajectory and/or travel distance for the golf ball.

Figure 1:
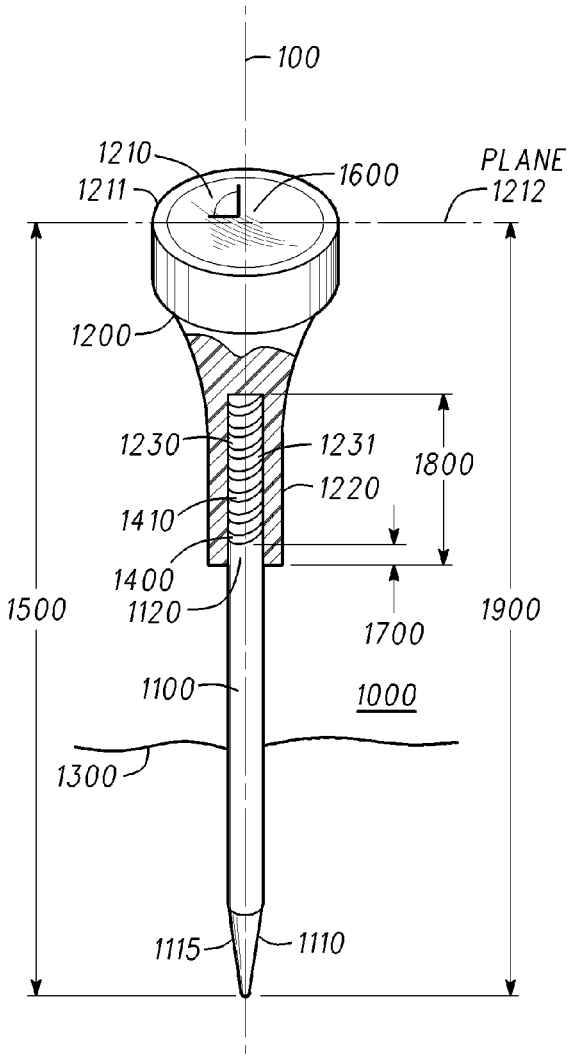
FIG. 1 illustrates a partial cross-sectional view of a golf tee in a relaxed configuration, in accordance with an embodiment.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf tee and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf tee and related methods described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

The terms "couple," "coupled," "couples," "coupling," and the like should be broadly understood and refer to connecting two or more elements or signals, electrically and/or mechanically, either directly or indirectly through intervening circuitry and/or elements. Two or more electrical elements may be electrically coupled, either direct or indirectly, but not be mechanically coupled; two or more mechanical elements may be mechanically coupled, either direct or indirectly, but not be electrically coupled; two or more electrical elements may be mechanically coupled, directly or indirectly, but not be electrically coupled. Coupling (whether only mechanical, only electrical, or both) may be for any length of time, e.g., permanent or semi-permanent or only for an instant.

The absence of the word "removably," "removable," and the like near the word "coupled," and the like does not mean that the coupling, etc. in question is or is not removable.

DETAILED DESCRIPTION

In one embodiment, a golf tee to support a golf ball comprises a first portion and a second portion coupled to the first portion. The second portion comprises a support section to support the golf ball. A perimeter of an end of the support section of the second portion defines a plane. The plane remains substantially perpendicular to an axis while the second portion moves relative to the first portion. Other embodiments of golf tees are disclosed below.

In one embodiment, a golf tee to support a golf ball, comprises a first portion, a second portion coupled to the first portion, an axis along the first and second portions, and a compressible material located between the first portion and the second portion. The golf tee can comprise a compressed configuration when the golf tee is subjected to a load, and a relaxed configuration when the load is removed. The second portion can comprise a support section to support the golf ball, and a perimeter of an end of the support section defining a plane, where the axis can be substantially perpendicular to the plane. The first and second portions can be displaceable, relative to each other, along the axis. The golf tee can be transitioned from the relaxed configuration to the compressed configuration when the load moves the second portion towards the first portion. The compressible material can be configured to increasingly compress along the axis as the golf tee is transitioned from the relaxed configuration to the compressed configuration, and to automatically return the golf tee to the relaxed configuration when the load is removed.

In one embodiment, a golf tee to support a golf ball can comprise a base portion and a support portion. The base portion can further comprise a base section to support the golf tee, and a first coupling section, opposite the base section. The support portion can further comprise a support section to support the golf ball, and a second coupling section, opposite the support section, to couple to the first coupling section. The support section of the support portion can comprise a center section. An axis traverses the base portion and the support portion through the center section of the support section. A compressible material can be coupled between the base portion and the support portion. The axis can be substantially collinear with a length of the golf tee. The support portion can be displaceable, along the axis, between a retracted position and an extended position relative to the base portion. While the support portion is displaced between the retracted position and the extended position, the center section remains along the axis, and the compressible material increasingly compresses along the axis.

In one example, a method of manufacture for a golf tee can comprise providing a first portion, providing a second portion complementary to the first portion, providing a compressible medium, and coupling together the first portion and the second portion such that the compressible medium is coupled between the first and second portions. The second portion can comprise a support section to support a golf ball. A perimeter of an end of the support section defines a plane. The second portion can be substantially displaceable, relative to the first portion, only along the longitudinal axis. While the second portion displaces relative to the first portion, the plane can remain substantially perpendicular to a longitudinal axis of the golf tee. The compressible material is configured to (1) increasingly compress between the first and second portions, and along the longitudinal axis, to transition the golf tee to a compressed configuration when the golf tee is subjected to a load; and (2) automatically decompress between the first and second portions, and along the longitudinal axis, to transition the golf tee from the compressed configuration to a relaxed configuration when the load is removed.

Figure 2:
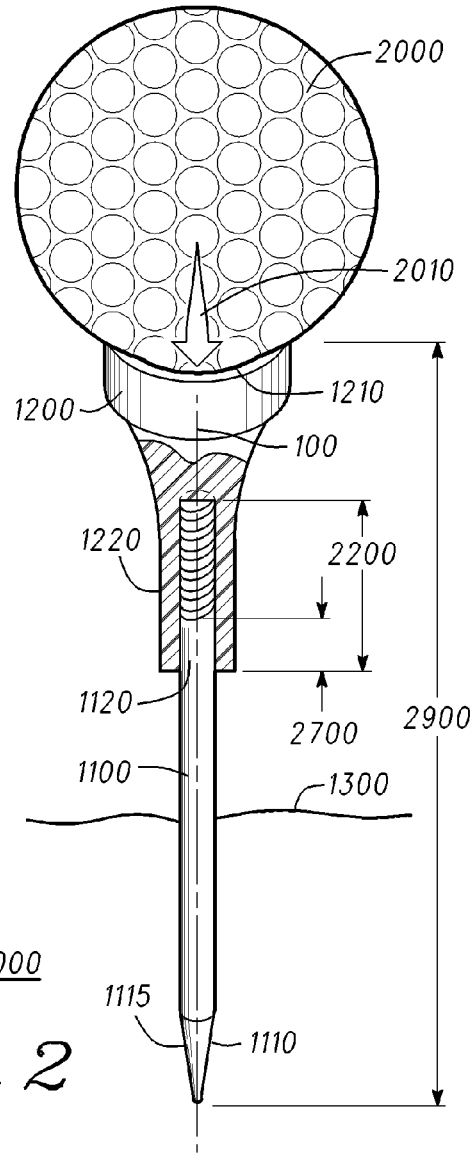
FIG. 2 illustrates a partial cross-sectional view of the golf tee of FIG. 1 in a semi-compressed configuration while supporting a golf ball.
Figure 3:
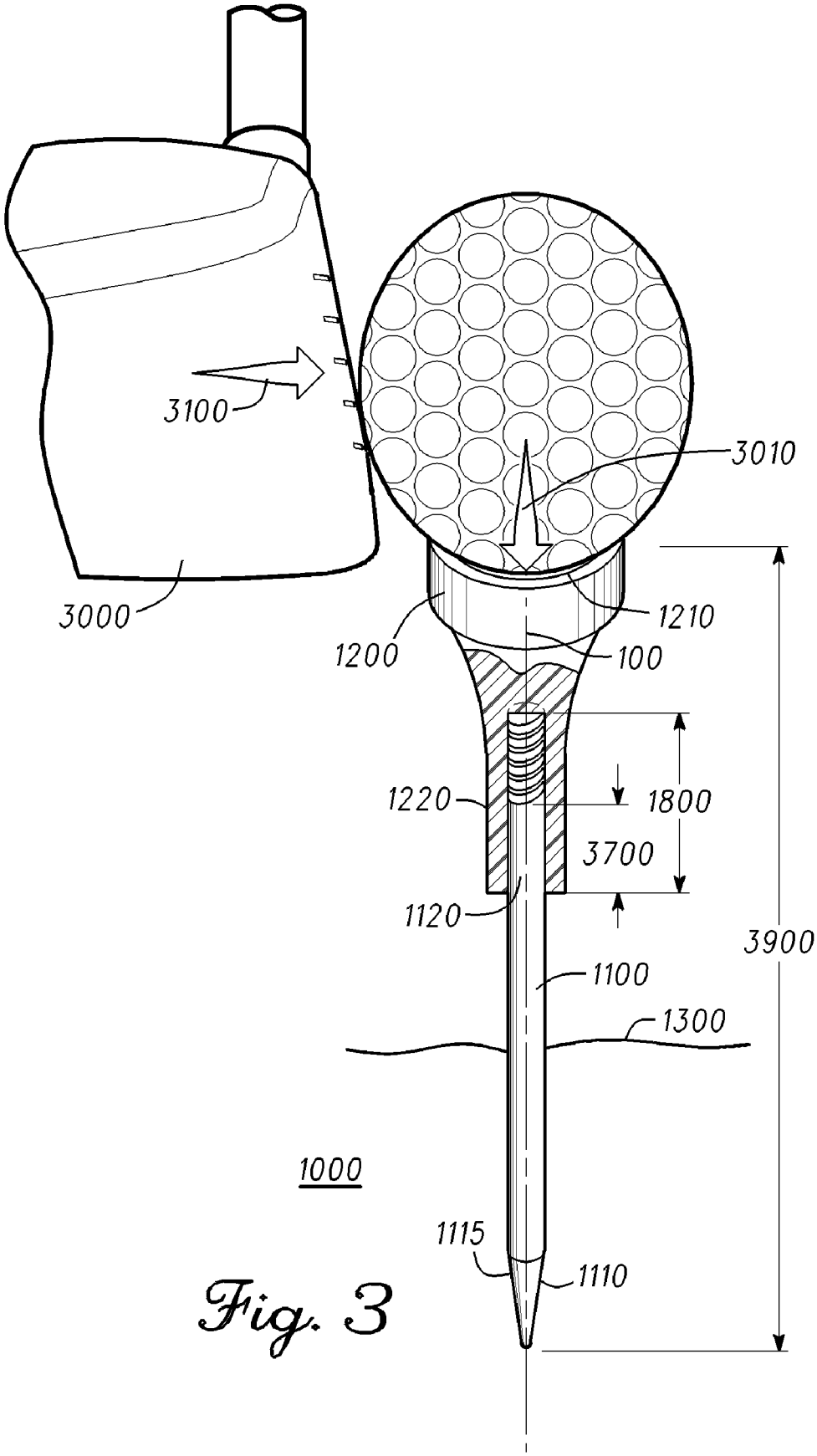
FIG. 3 illustrates a partial cross-sectional view of the golf tee of FIG. 1 in a more compressed configuration as the golf ball is struck by a golf club.

Referring now to the figures, FIG. 1 illustrates a partial cross-sectional view of golf tee 1000 in a relaxed configuration. FIG. 2 illustrates a partial cross-sectional view of golf tee 1000 in a semi-compressed configuration while supporting a golf ball. FIG. 3 illustrates a partial cross-sectional view of golf tee 1000 in a more compressed configuration as the golf ball is struck by a golf club. The relaxed configuration can be referred to as an extended configuration, and the semi-compressed or compressed configuration can be referred to as a semi-retracted or retracted configuration, respectively.

As illustrated in the examples of FIGS. 1-3, golf tee 1000 may support a golf ball over a golf-playing surface. An individual may use a golf club to hit the golf ball off of golf tee 1000 to minimize interference from the golf-playing surface. In the present example, the golf ball is illustrated as golf ball 2000 in FIGS. 2-3, while the golf club is illustrated as golf club 3000 in FIG. 3. Golf tee 1000 provides additional benefits not found in traditional golf tees, as will be described below.

In the present example of FIGS. 1-3, golf tee 1000 is presented as already positioned over golf-playing surface 1300. Golf-playing surface 1300 can be any kind of surface over which an individual might want to position golf ball 2000. In one example, golf-playing surface 1300 comprises the surface of a tee box on a golf course. In a different example, golf-playing surface 1300 can comprise other surfaces of a golf course, such as sand traps, fairways, rough areas, and even surfaces off a golf course such as a driving range. Although golf-playing surface 1300 is presented as substantially flat in FIGS. 1-3, it is not restricted to being flat, but can be angled or sloped, as long as it can provide the necessary support for golf tee 1000 to hold golf ball 2000.

Golf tee 1000, as shown in FIGS. 1-3, comprises portion 1100 and portion 1200. In some embodiments, portion 1100 can comprise a base portion to support golf tee 1000, while portion 1200 can comprise a support portion to support a golf ball. Portion 1100 comprises pairing section 1120, which is complementary to pairing section 1220 on portion 1200. In some embodiments, pairing sections 1120 and 1220 can be referred to as coupling sections.

The complementary nature of pairing sections 1120 and 1220 allows them to securely couple together, and thereby couple portion 1100 with portion 1200, such that portion 1100 can support portion 1200 when golf tee 1000 is in use. As a result of the coupling between portion 1100 and portion 1200, as in the present example, portion 1100 and portion 1200, and more specifically pairing sections 1120 and 1220, may overlap by an overlap distance 1700 with respect to each other.

In one embodiment, portion 1100 and/or portion 1200 can comprise a metallic material, a wooden material, a nylon material, and/or a polypropylene material. Portions 1100 and 1200 can comprise same materials or different materials. The apparatus, methods, and articles of manufacture described herein are not limited in this regard.

Portion 1100 of golf tee 1000 comprises base section 1110 that can serve to support golf tee 1000 in a position over golf-playing surface 1300. Base section 1110 is located at an end of portion 1100 opposite from pairing section 1120. In the present embodiment, base section 1110 includes pointed spike 1115 to insert into golf-playing surface 1300. Pointed spike 1115 can be dull or sharp. Friction exerted around pointed spike 1115 by golf-playing surface 1300 keeps base section 1110, and the rest of golf tee 1000, in position over golf-playing surface 1300. Although in the present embodiment base section 1110 is illustrated to include pointed spike 1115, base section 1110 could be implemented otherwise without deviating from the inventive concepts described herein. For example, in one embodiment, base section 1110 could be implemented via a flat surface that rests on top of golf-playing surface 1300. In a different embodiment, base section 1110 could be part of, or permanently attached to, golf-playing surface 1300.

Portion 1200 of golf tee 1000 comprises support section 1210 to support golf ball 2000 over golf-playing surface 1300. Support section 1210 is located at an end of portion 1200 opposite from pairing section 1220. In the present embodiment, support section 1210 is represented as a cup curvature on top of portion 1200. The cup curvature can be complementary to a spherical surface section of golf ball 2000. As illustrated in FIG. 2, the cup curvature of portion 1200 can couple to the spherical surface section of golf ball 2000, allowing support section 1210 to retain golf ball 2000 in place over golf-playing surface 1300 when golf ball 2000 is positioned over portion 1200 of golf tee 1000. Although in the present embodiment support section 1210 is illustrated as a cup, support section 1210 could be implemented otherwise without deviating from the inventive concepts described herein. For example, in one embodiment, support section 1210 could be implemented via a prong mechanism, wherein prongs are configured to contact different points on the spherical surface section of golf ball 2000 to retain golf ball 2000 in position over portion 1200.

In the present embodiment, as illustrated in FIG. 1, an axis 100 crosses through golf tee 1000 parallel to longest dimension 1500 of golf tee 1000. In addition, perimeter 1211 of support section 1210 defines plane 1212 substantially perpendicular to axis 100. Longest dimension 1500 comprises the distance between an end of portion 1200, at support section 1210, to an end of portion 1100, at base section 1110. Axis 100, collinear within center section 1600 of golf tee 1000, crosses through portion 1200 and continues through portion 1100, from end to end of golf tee 1000. As an example, FIG. 1 shows axis 100 passing through golf tee 1000 and being substantially perpendicular to golf-playing surface 1300 while golf-playing surface 1300 supports golf tee 1000. The example of FIG. 1 also shows plane 1212 being substantially parallel to golf-playing surface 1300.

In the present example, section 1220 of portion 1200 also comprises displacement mechanism 1230 defining displacement distance 1800. FIGS. 1-3 represent displacement mechanism 1230 as chamber 1231. Physical dimensions of displacement mechanism 1230 at section 1220 are complementary to section 1120, permitting portion 1100 to couple with portion 1200. Once coupled, portion 1200 can move relative to portion 1100, along axis 100, as displacement mechanism 1230 displaces over section 1120.

Golf tee 1000 may also comprise compressible material 1400. In the present example of FIGS. 1-3, compressible material 1400 is located between portion 1200 and portion 1100, within chamber 1231 of displacement mechanism 1230. Compressible material 1400, in the present embodiment, comprises spring 1410. In the same or a different embodiment, compressible material could also comprise a foam cushion, a urethane cushion, a sponge, a soft plastic, a body of air, a gaseous cushion, a liquid cushion, a gel cushion, and other materials capable of being compressed and of substantially regaining their original volume when under no load, whether aided or automatically. In the same or a different embodiment, compressible material 1400 comprises a degree of compressibility that determines the level of rigidity or flexibility that compressible material 1400 has when reacting to external forces acting upon golf tee 1000.

In the present embodiment, FIG. 1 illustrates golf tee 1000 in a relaxed configuration, relative to the positions of portion 1100 and of portion 1200 with respect to each other. The relaxed configuration can be attained while golf tee 1000 is under no external load.

While in the relaxed configuration, golf tee 1000 exhibits height 1900, extending parallel to axis 100 from a top end of support section 1210 to a bottom end of base section 1110. Also while golf tee 1000 is in the relaxed configuration, portion 1200 lies in an extended position with respect to portion 1100. In addition, section 1120 and section 1220 maintain overlap distance 1700 with respect to each other. In the present example, compressible material 1400 is in a relaxed state, automatically pushing portion 1200 away from portion 1100, to maintain height 1900 for the relaxed configuration of golf tee 1000. In a different embodiment, compressible material 1400 may be absent, and the relaxed configuration could be maintained, for example, via friction forces between section 1120 and displacement mechanism 1230 of section 1220. When compressible material 1400 is absent from golf tee 1000, golf tee 1000 will not automatically return to the relaxed configuration from the semi-compressed configuration or the compressed configuration.

In the present embodiment, FIG. 2 illustrates golf tee 1000 in a semi-compressed configuration relative to the positions of portion 1100 and portion 1200 with respect to each other. The semi-compressed configuration can be attained while golf tee 1000 is under some external load, such as weight 2010 of golf ball 2000 pushing portion 1200 towards portion 1100.

While in the semi-compressed configuration, golf tee 1000 exhibits height 2900, extending parallel to axis 100 from a top end of support section 1210 to a bottom end of base section 1110, wherein height 1900 from FIG. 1 is greater than height 2900. Also while golf tee 1000 is in the semi-compressed configuration, portion 1200 lies closer to a retracted position with respect to portion 1100. In addition, section 1120 and section 1220 may overlap by overlap distance 2700 with respect to each other, wherein overlap distance 2700 is greater than overlap distance 1700 from FIG. 1. As illustrated for the semi-compressed configuration in FIG. 2, compressible material 1400 prevents weight 2010 of golf ball 2000 from pushing portion 1200 fully onto portion 1100, thus maintaining height 2900 and inhibiting golf tee 1000 from reaching a fully compressed configuration. In a different embodiment, compressible material 1400 may be absent, and the semi-compressed configuration could be maintained, for example, via friction forces between section 1120 and displacement mechanism 1230 of section 1220.

In the present embodiment, FIG. 3 illustrates golf tee 1000 in a compressed configuration, relative to the positions of portion 1100 and portion 1200 with respect to each other. The compressed configuration can be attained while golf tee 1000 is under some external load greater than the weight 2010 (FIG. 2) of golf ball 2000, such as for example expansion force 3010. As illustrated by FIG. 3, as golf ball 2000 is struck by golf club head 3000, golf ball 2000 deforms by expanding substantially perpendicularly to strike path 3100 of golf club head 3000. As golf ball 2000 expands, it generates an expansion force 3010 towards portion 1200. Expansion force 3010 is greater in magnitude than weight 2010 (FIG. 2) of golf ball 2000, and can drive golf tee 1000 from the semi-compressed configuration (FIG. 2) to the compressed configuration (FIG. 3).

While in the compressed configuration, golf tee 1000 exhibits height 3900, extending parallel to axis 100 from a top end of support section 1210 to a bottom end of base section 1110, wherein height 2900 from FIG. 2 is greater than height 3900. Also while golf tee 1000 is in the compressed configuration, portion 1200 lies at a retracted position with respect to portion 1100. In addition, section 1120 and section 1220 may overlap by overlap distance 3700 with respect to each other, wherein overlap distance 3700 is greater than overlap distance 2700 from FIG. 2. In one embodiment, a difference in magnitude between overlap distance 1700 (FIG. 1) and overlap distance 3700 is from about 0.15 centimeters (cm) to about 0.35 cm. As illustrated for the present example in FIG. 3, golf tee 1000 attains height 3900 for the compressed configuration as compressible material 1400 lies compressed and resists expansion force 3010 as expansion force 3010 pushes portion 1200 towards portion 1100. In the compressed configuration, compressible material 1400 can be fully compressed or less than fully compressed. Similarly, in the relaxed configuration (FIG. 1), compressible material 1400 can be fully relaxed or less than fully relaxed.

Throughout the different configurations possible for golf tee 1000 of FIGS. 1-3, as portion 1200 moves relative to portion 1100, the complementary configuration and interaction of displacement mechanism 1230 with both section 1120 and section 1220 maintain plane 1212 (FIG. 1) substantially perpendicular to axis 100 of golf tee 1000 and can also maintain center section 1600 substantially collinear with axis 100.

Golf tee 1000, and other similar embodiments, can be compliant with the United States Golf Association's rules for spring tees. In particular, the rules may require golf tees to have certain dimensions such as a total length not longer than 4 inches or 10.16 cm. Further, the rules indicate that the golf tees may not be designed or manufactured to provide an indication of a line of play, and must not influence a movement of a golf ball. Golf tee 1000, and other similar embodiments, can be compliant with the rules of other golf standard organizations or governing bodies such as the Royal Ancient Golf Club of St. Andrews (R&A).

For the present or other embodiments, the ability of golf tee 1000 to move towards a compressed configuration can be beneficial for inhibiting the golf tee from influencing a spin rate or a launch angle of a golf ball. Spin rates and launch angles imparted by a golf club striking the golf ball can be affected by the amount of resistance the golf tee presents to the golf ball as it leaves the golf tee. Golf tee resistance may thus affect the trajectory of the golf ball. If the golf tee presents too much resistance as the golf ball leaves the golf tee, the spin rate of the golf ball may be increased, and/or its launch angle could be affected. As illustrated in FIG. 3 for the present example, the ability of golf tee 1000 to move towards the compressed configuration, as detailed above, can allow support section 1210 to essentially move out of the way and present less resistance to golf ball 2000 as it leaves golf tee 1000 when struck by golf club 3000. This decreased resistance can inhibit interactions that could affect the spin rate and/or the launch angle of golf ball 2000, and that could interfere with the intended flight path for golf ball 2000.

Figure 28:
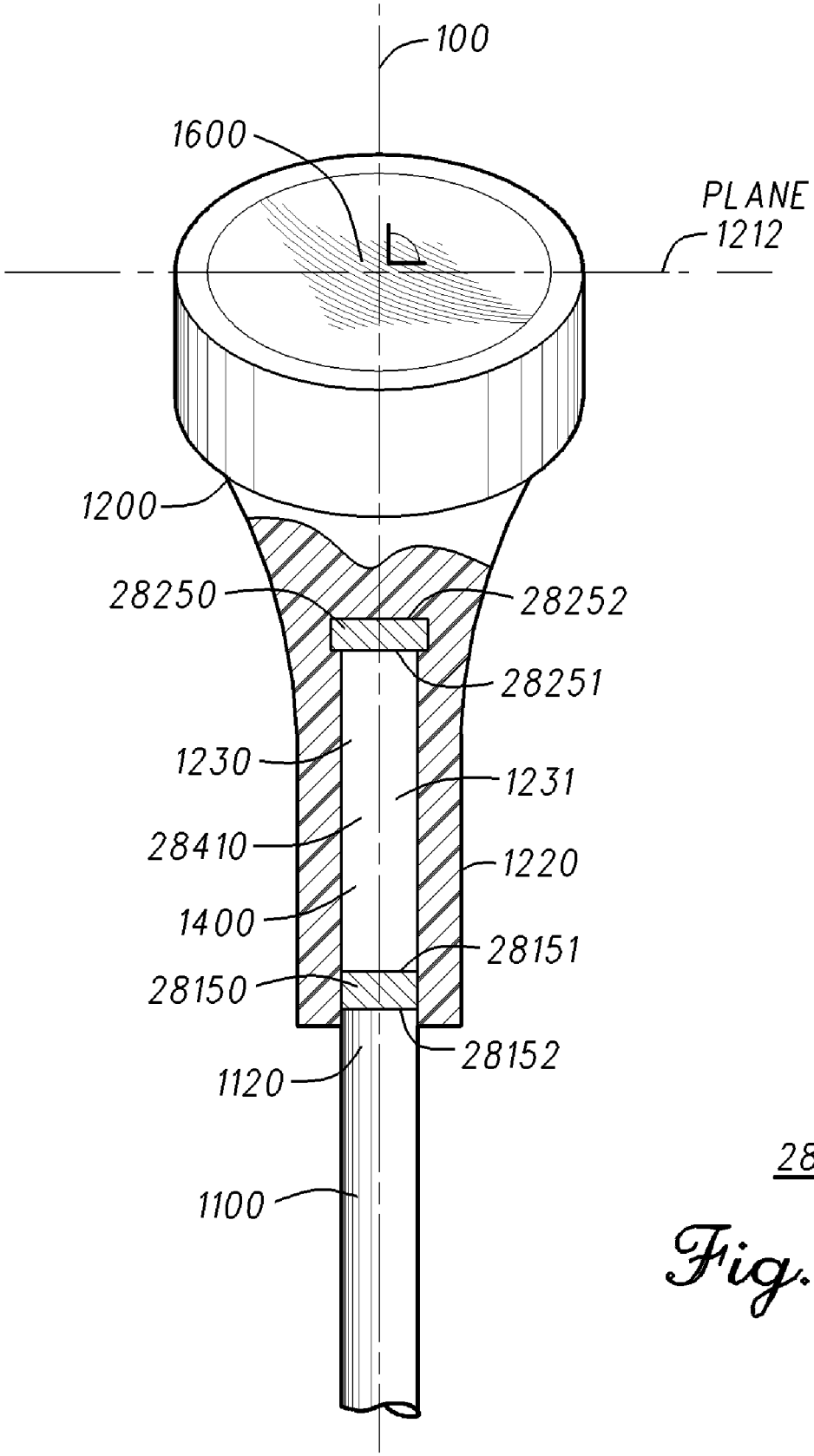
FIG. 28 illustrates a partial cross-sectional view of a golf tee, which is a yet another embodiment of the golf tee of FIGS. 1-3.

Skipping ahead in the figures, FIG. 28 illustrates a partial cross-sectional view of golf tee 28000. Golf tee 28000 is similar to golf tee 1000 as described for FIGS. 1-3, but further comprises a magnetic mechanism. The magnetic mechanism comprises magnet 28250, which can be located at, and can be a portion of, pairing section 1220 in portion 1200. The magnetic mechanism also comprises magnet 28150, which can be located at, and can be a portion of, pairing section 1120 in portion 1100. Magnets 28150 and 28250 thus lay at opposite ends of chamber 1231 of displacement mechanism 1230, and are oriented such that their respective poles repel each other.

In the present example, magnet 28250 is oriented such that its positive pole 28251 faces positive pole 28151 of magnet 28150 across chamber 1231 and along axis 100. In a different example, magnet 28250 can be oriented such that its negative pole 28252 faces negative pole 28152 of magnet 28150 along axis 100. In both scenarios, the net effect would be the same. Magnets 28150 and 28250 would repel each other across displacement mechanism 1230 when pairing sections 1220 and 1120 are coupled together. Magnets 28150 and 28250 maintain golf tee 28000 at the relaxed configuration when under no load, and allow golf tee 28000 to approach the compressed configuration in situations similar to those described for golf tee 1000 of FIGS. 1-3. For example, golf tee 2800 is in the semi-compressed configuration when golf tee 28000 supports a golf ball.

In one embodiment, the magnetic mechanism can replace compressible material 1400 altogether, relying solely on the repelling force between magnets 28250 and 28150 to allow golf tee 28000 to compress or decompress as required. In a different embodiment, the magnetic compression mechanism can work in tandem with compressible material 1400, such as air or gaseous cushion 28410 within chamber 1231 in the present example.

Figure 4:
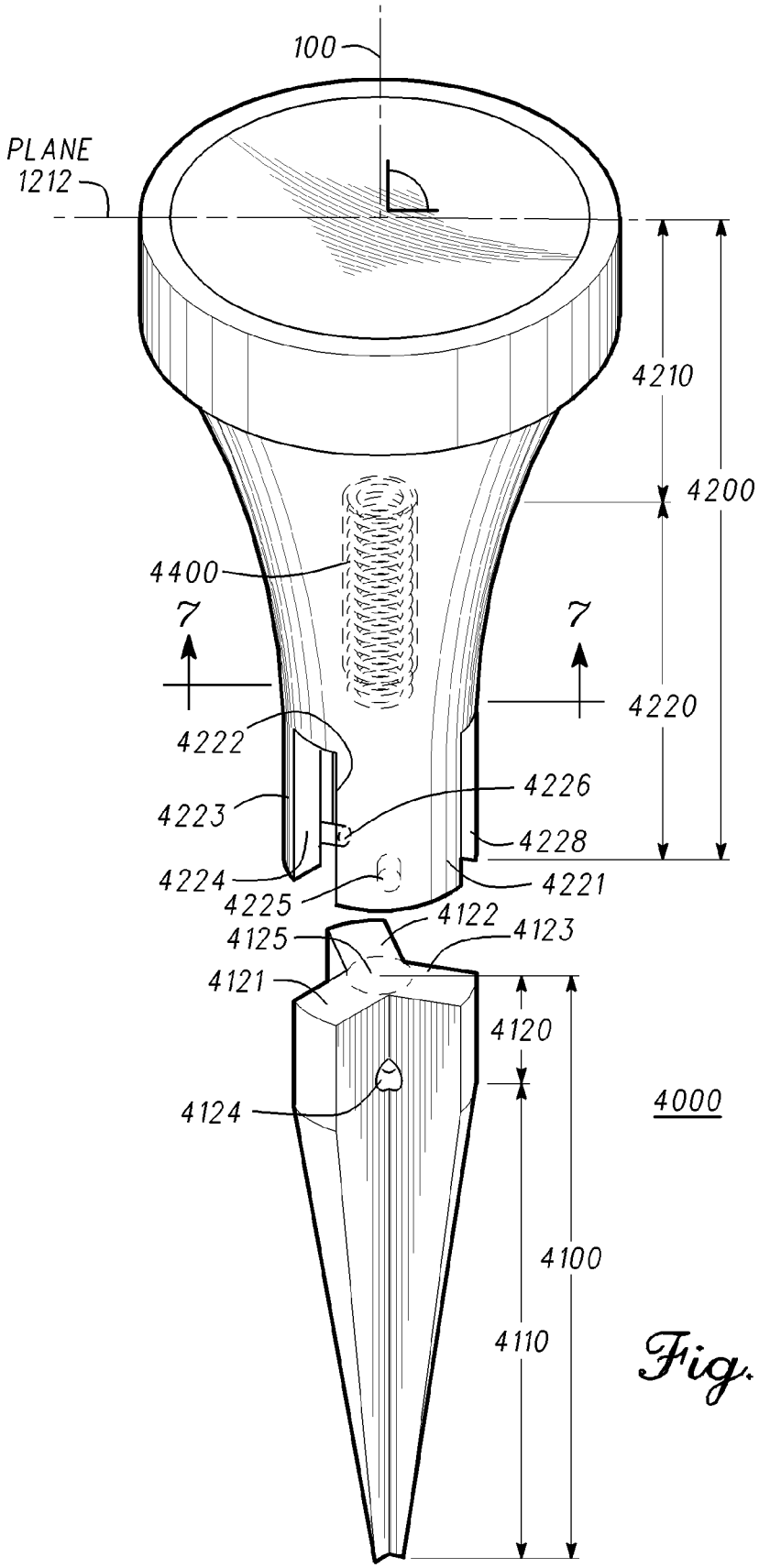
FIG. 4 illustrates an exploded view of a golf tee, which is a different embodiment of the golf tee of FIGS. 1-3.
Figure 5:
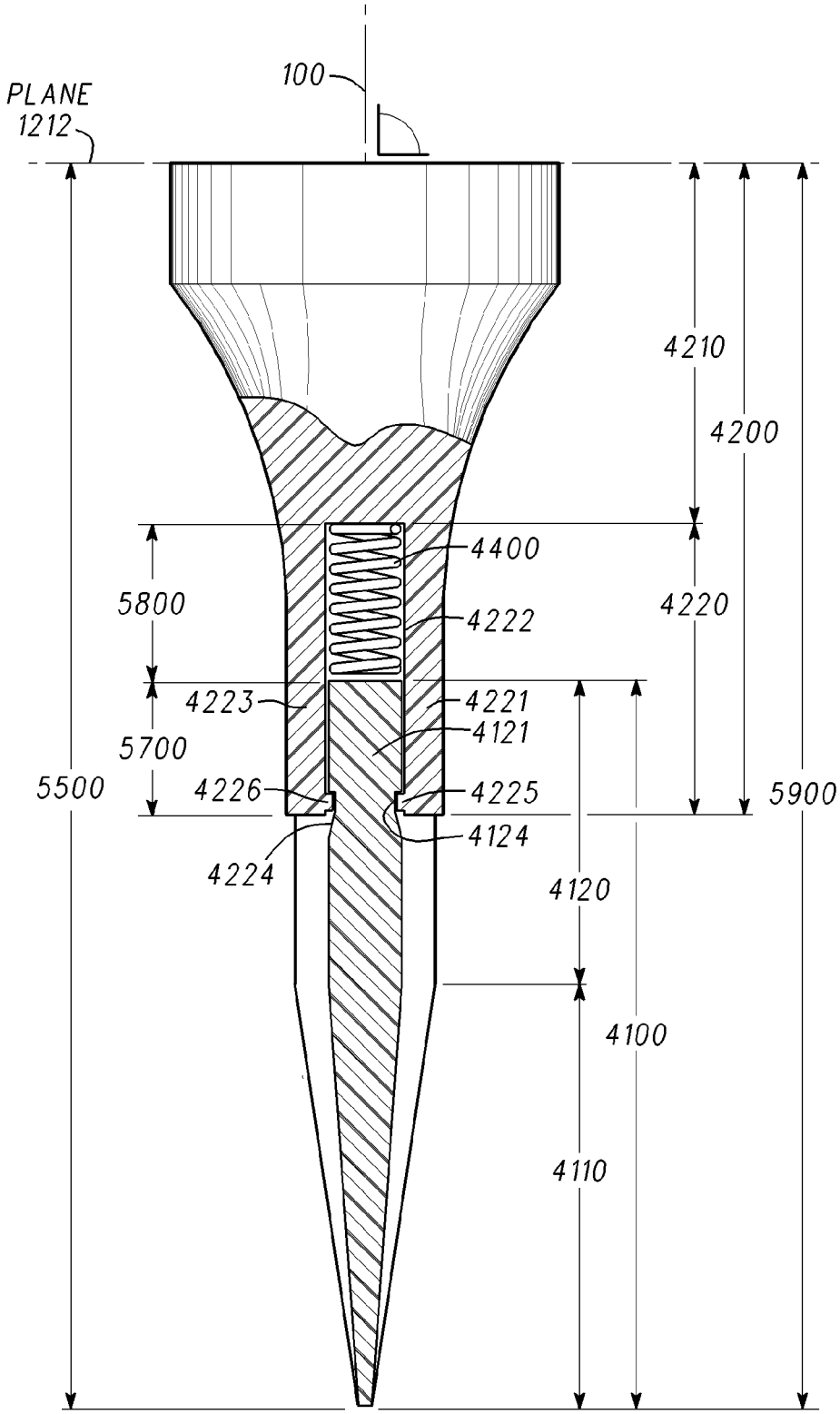
FIG. 5 illustrates a partial cross-sectional side view of the golf tee of FIG. 4 in a relaxed configuration.
Figure 6:
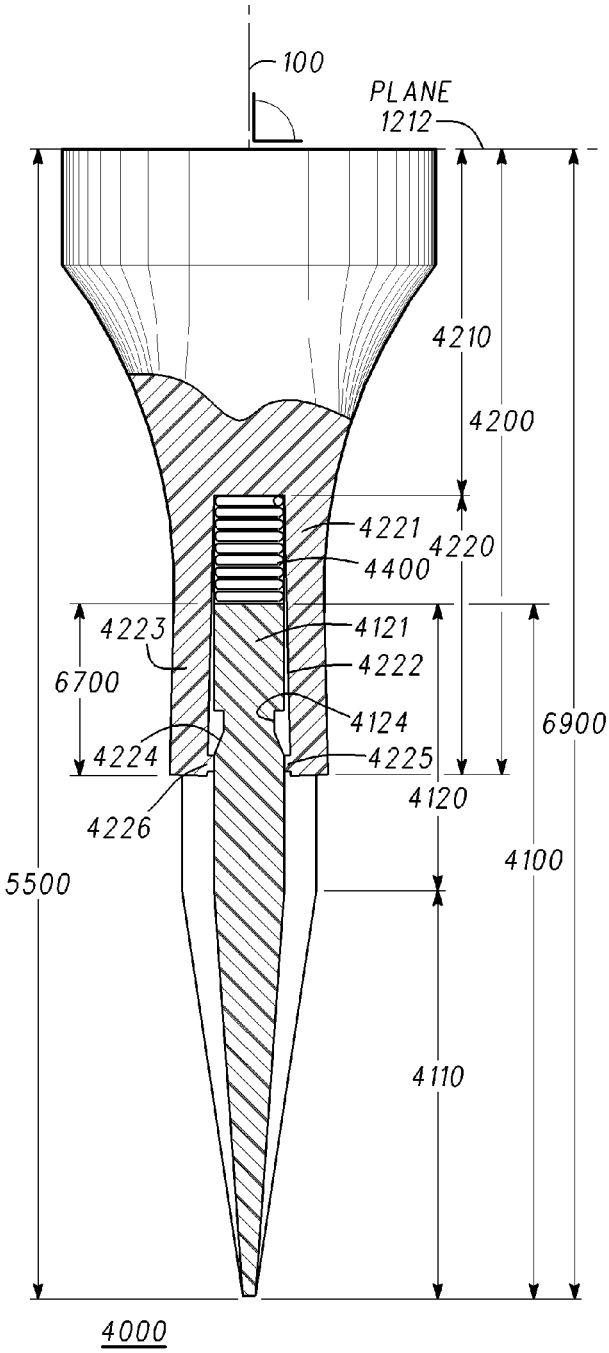
FIG. 6 illustrates a partial cross-sectional side view of the golf tee of FIG. 4 in a compressed configuration.
Figure 7:
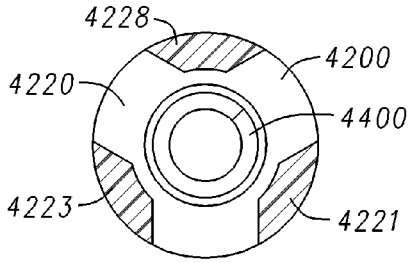
FIG. 7 illustrates a cross-sectional view of a portion of the golf tee of FIG. 4, taken along a section line 7-7 in FIG. 4.
Figure 8:
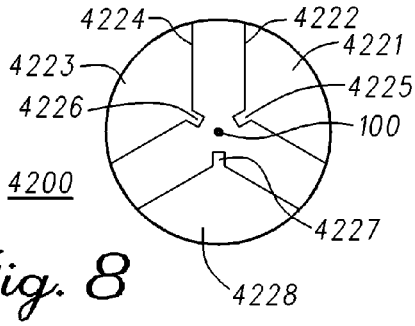
FIG. 8 illustrates a bottom view of the same portion of the golf tee of FIG. 4.
Figure 9:
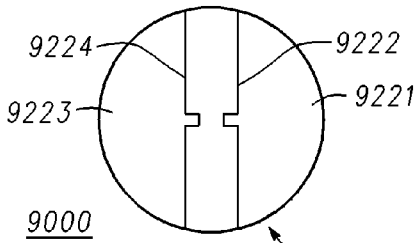
FIG. 9 illustrates a bottom view of a portion of a golf tee, which is a different embodiment of the portion of the golf tee of FIG. 8.
Figure 10:
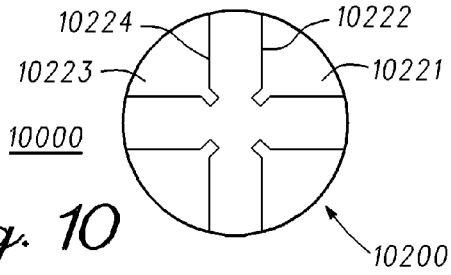
FIG. 10 illustrates a bottom view of a portion of a golf tee, which is another embodiment of the portion of the golf tee of FIG. 8.

Backtracking through the figures, FIG. 4 illustrates an exploded view of golf tee 4000, which is a different embodiment of golf tee 1000 of FIGS. 1-3. FIG. 5 illustrates a partial cross-sectional side view of golf tee 4000 of FIG. 4 in a relaxed configuration. FIG. 6 illustrates a partial cross-sectional side view of golf tee 4000 of FIG. 4 in a compressed configuration. FIG. 7 illustrates a cross-sectional view of portion 4200 of golf tee 4000 of FIG. 4, taken along a section line 7-7 in FIG. 4. FIG. 8 illustrates a bottom view of portion 4200 of golf tee 4000 of FIG. 4. FIG. 9 illustrates a bottom view of portion 9200 of golf tee 9000, which is a different embodiment of portion 4200 of golf tee 4000 in FIG. 8. FIG. 10 illustrates a bottom view of portion 10200 of golf tee 10000, which is a different embodiment of portion 4200 of golf tee 4000 in FIG. 8.

As illustrated in FIG. 4, golf tee 4000 comprises portion 4100 and portion 4200, which can be similar to portion 1100 and portion 1200, respectively, of golf tee 1000 from FIGS. 1-3. Portion 4100 comprises section 4120 and base section 4110, which can be similar to pairing section 1120 and base section 1110, respectively, of golf tee 1000 from FIGS. 1-3. Portion 4200 comprises section 4220 and support section 4210, which can be similar to pairing section 1220 and support section 1210, respectively, of golf tee 1000 from FIGS. 1-3.

Golf tee 4000 also comprises longest dimension 5500 (FIG. 5), height 5900 (FIG. 5), height 6900 (FIG. 6), displacement distance 5800 (FIG. 5), overlap distance 5700 (FIG. 5), and overlap distance 6700 (FIG. 6). These elements can be similar to longest dimension 1500, height 1900, height 3900, displacement distance 1800, overlap distance 1700, overlap distance 2700, and overlap distance 3700, respectively, as described for golf tee 1000 from FIGS. 1-3. Golf tee 4000 can also have an intermediate height, which can be similar to height 2900 of golf tee 1000 in FIG. 3.

In one embodiment, golf tee 4000 may also comprise compressible material 4400, which can be similar to compressible material 1400 of golf tee 1000 from FIGS. 1-3. In addition, golf tee 4000 comprises axis 100 and plane 1212, as described for golf tee 1000 from FIGS. 1-3.

Golf tee 4000 is also capable of attaining a relaxed configuration as illustrated in FIG. 5, a semi-compressed configuration, and a compressed configuration as illustrated in FIG. 6. These configurations can be similar, respectively, to the relaxed configuration illustrated in FIG. 1, the semi-compressed configuration illustrated in FIG. 2, and the compressed configuration illustrated in FIG. 3, for golf tee 1000.

Finally, golf tee 4000 is also capable of supporting a golf ball (which can be similar to golf ball 2000 from FIGS. 2-3) over a golf-playing surface (which can be similar to golf-playing surface 1300 of FIGS. 1-3) as the golf ball is struck by a golf club (which can be similar to golf club 3000 of FIG. 3). Golf tee 4000 is capable of reacting to a weight of the golf ball, and to forces exerted upon it when the golf club strikes the golf ball, in a similar fashion as described earlier for golf tee 1000 of FIGS. 1-3.

Golf tee 4000 differs structurally from golf tee 1000 with respect to structural elements of portion 4100 and portion 4200. As illustrated in FIG. 4, portion 4100 of golf tee 4000 comprises at least tab 4121 at section 4120. Tab 4121 extends parallel to axis 100 along section 4120, and outward from axis 100 with respect to center section 4125 of section 4120. In the present embodiment shown in FIGS. 4-6, golf tee 4000 further comprises tab 4122 and tab 4123, both of which can be similar to tab 4121. Different combinations, in terms of the number, shape, and size of tabs, are possible in other embodiments.

Portion 4100 of golf tee 4000 also comprises bracket 4124 at section 4120. Bracket 4124 can be located at a point along center section 4125 and can be coupled to or between tabs 4121 and 4123. In the present embodiment shown in FIGS. 4-6, golf tee 4000 further comprises two additional brackets, which can be similar to bracket 4124. One of the two additional brackets can be coupled to or between tabs 4121 and 4122, and the other of the two additional brackets can be coupled to or between tabs 4122 and 4123. Different combinations, in terms of the number, shape, and size of brackets, are possible in other embodiments.

Portion 4200 of golf tee 4000, as illustrated in FIGS. 4-8, and in particular FIG. 8, comprises at least prong 4221 with wall 4222, prong 4223 with wall 4224, and stub 4225, all at section 4220. Prong 4221 extends parallel to axis 100 along section 4220. In turn, prong 4223 extends parallel to prong 4221 and to axis 100. Stub 4225 lies at an end of prong 4221. In the embodiment shown in FIGS. 4-8, section 4220 also comprises stub 4226 at an end of prong 4223, and stub 4227 at an end of prong 4228. Different combinations, in terms of the number, shape, and size of prongs and stubs, are possible in other embodiments.

In the present embodiment, section 4220 includes compressible material 4400, comprising a spring, at section 4220. In other embodiments, compressible material 4400 could be absent, or could comprise other materials such as those materials described for compressible material 1400 in FIGS. 1-3. As illustrated in FIG. 5, compressible material 4400 lies between section 4100 and section 4200 when coupled together. In addition, FIG. 7 illustrates a cross sectional view of portion 4200, showing compressible material 4400 located in section 4220. When compressible material 4400 is absent from golf tee 4000, golf tee 4000 can rely on friction between portions 4100 and 4200 to maintain the relaxed configuration and the semi-compressed configuration. In such an embodiment, however, golf tee 4000 will not automatically return to the relaxed configuration from the semi-compressed configuration or the compressed configuration.

FIG. 8 illustrates a bottom view of a bottom-side of portion 4200. Prong 4221 is shown having wall 4222 substantially parallel to, and across from, wall 4224 of prong 4223. Wall 4222 and wall 4224 are separated by a distance that is complementary to a width of tab 4121 of section 4120 (FIG. 4). This complementary shape allows wall 4222 of prong 4221, and wall 4224 of prong 4223, to straddle tab 4121 when portion 4100 and portion 4200 are coupled together, as shown in FIGS. 5-6. The straddling of tab 4121 allows wall 4222 and wall 4224 to guide portion 4200 along axis 100 as portion 4200 moves with respect to portion 4100.

While golf tee 4000 is in the relaxed configuration, as shown in FIG. 5, stub 4225 of prong 4221 couples to bracket 4124 of portion 4100 and inhibits support section 4210 from moving further away from base section 4110, thus keeping portion 4200 and portion 4100 coupled together.

As golf tee 4000 moves towards the compressed configuration, as illustrated in FIG. 6, stub 4225 of prong 4221 moves away from bracket 4124 along the direction of axis 100, and bracket 4124 moves further into the cavity within section 4220 of portion 4200. Similarly, stubs 4226 and 4227 move away from their respective brackets of portion 4100 along the direction of axis 100.

Upon reaching the compressed configuration, golf tee 4000 will exhibit height 6900, as shown in FIG. 6. Height 6900 is less than height 5900 exhibited by golf tee 4000 when in the relaxed configuration (FIG. 5). Portion 4200 can traverse up to displacement distance 5800 (FIG. 5) along axis 100 towards portion 4100 as golf tee 4000 moves from the relaxed configuration to the compressed configuration. The overlap between portions 4100 and 4200 also increases from overlap distance 5700 (FIG. 5) to overlap distance 6700 (FIG. 6), as golf tee 4000 moves from the relaxed configuration to the compressed configuration.

FIG. 9 illustrates a view of a bottom side of portion 9200 for golf tee 9000. The view of FIG. 9 can be similar to the view of FIG. 8. Golf tee 9000 in FIG. 9 can be similar to golf tee 4000 of FIGS. 4-8, but can differ structurally in that it comprises two tabs with two prongs, rather than three tabs with three prongs as for golf tee 4000. Prong 9221 comprises wall 9222 that is substantially parallel to, and across from, wall 9224 of prong 9223. Wall 9222 and wall 9224 are separated by a distance that is complementary to a width of a tab to be inserted between walls 9222 and 9224. In the illustrated embodiment, the distance is substantially constant along walls 9222 and 9224, but in a different embodiment, the distance can vary along walls 9222 and 9224.

FIG. 10 illustrates a view of a bottom side of portion 10200 for golf tee 10000. The view of FIG. 10 can be similar to the view of FIG. 8. Golf tee 10000 can be similar in function to golf tee 4000 of FIGS. 4-8, but can differ structurally in that it comprises four tabs with four prongs, rather than three tabs with three prongs as for golf tee 4000. Prong 10221 comprises wall 10222 that is substantially parallel to, and across from, wall 10224 of prong 10223. Wall 10222 and wall 10224 are separated by a distance that is complementary to a width of a tab to be inserted between walls 10222 and 10224. The other prongs and walls illustrated in FIG. 10 can be similar to prongs 10221 and 10223 and walls 10222 and 10222. Other embodiments with different combinations, shapes, and sizes of tabs, walls, and prongs are similarly possible, and encompassed by, the inventive concepts herein described.

Figure 11:
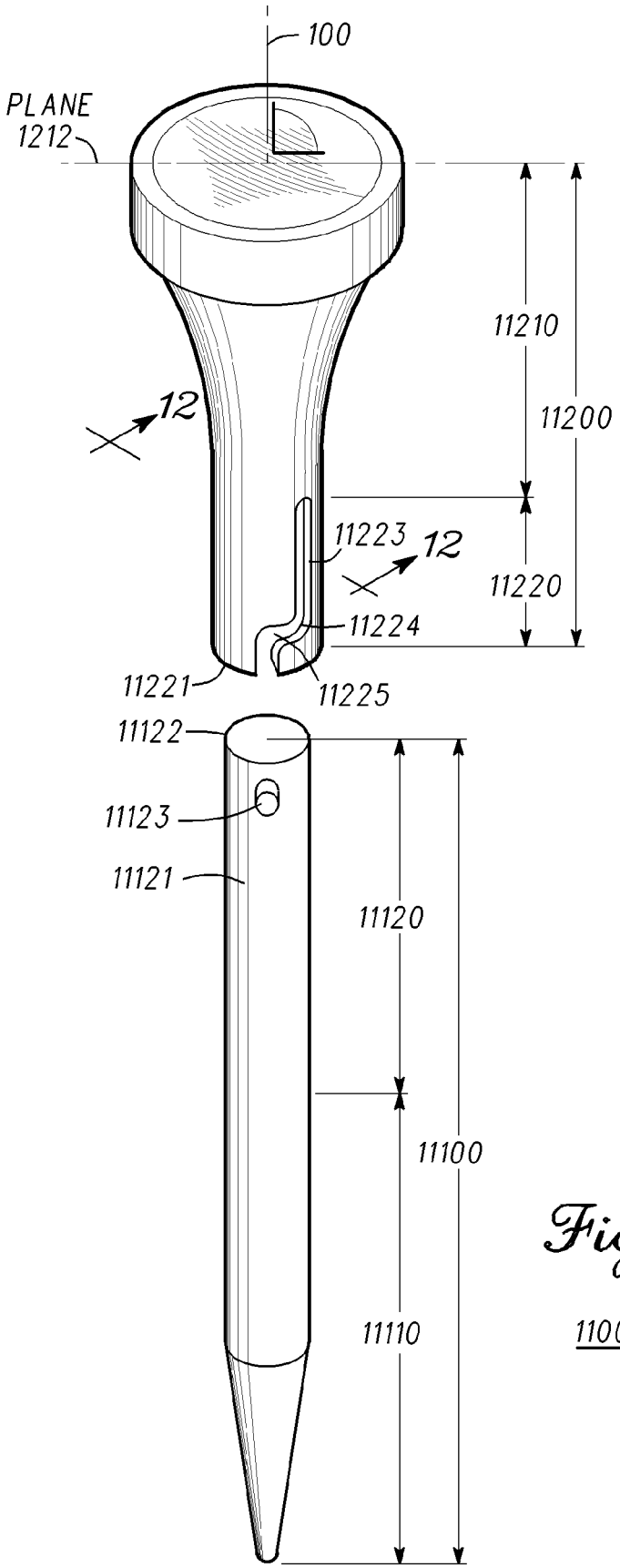
FIG. 11 illustrates an exploded view of a golf tee, which is a further embodiment of the golf tee of FIGS. 1-3.
Figure 12:
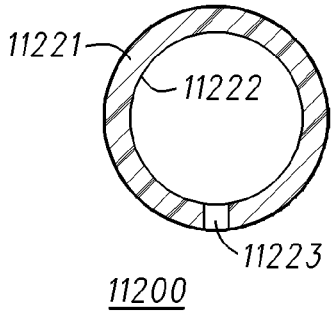
FIG. 12 illustrates a cross-sectional view of a second portion of the golf tee of FIG. 11, taken along a section line 12-12 in FIG. 11.
Figure 13:
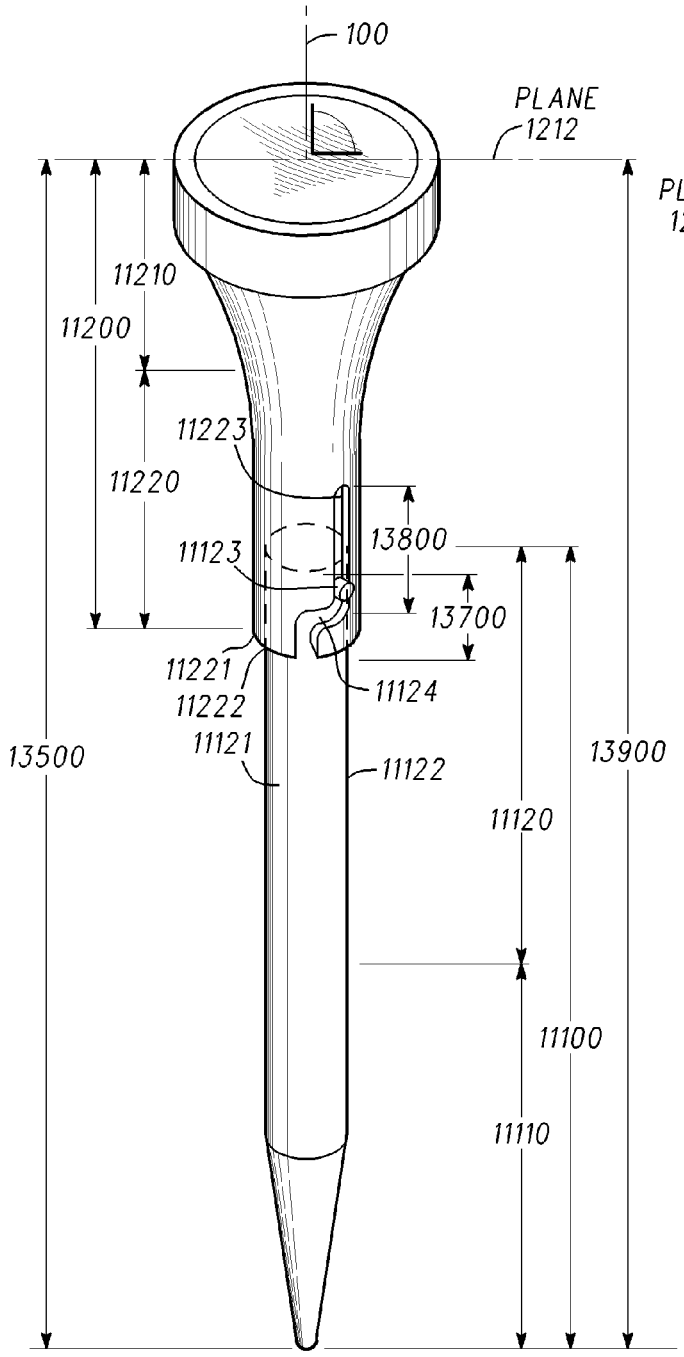
FIG. 13 illustrates a side view of the golf tee of FIG. 11 in a relaxed configuration.
Figure 14:
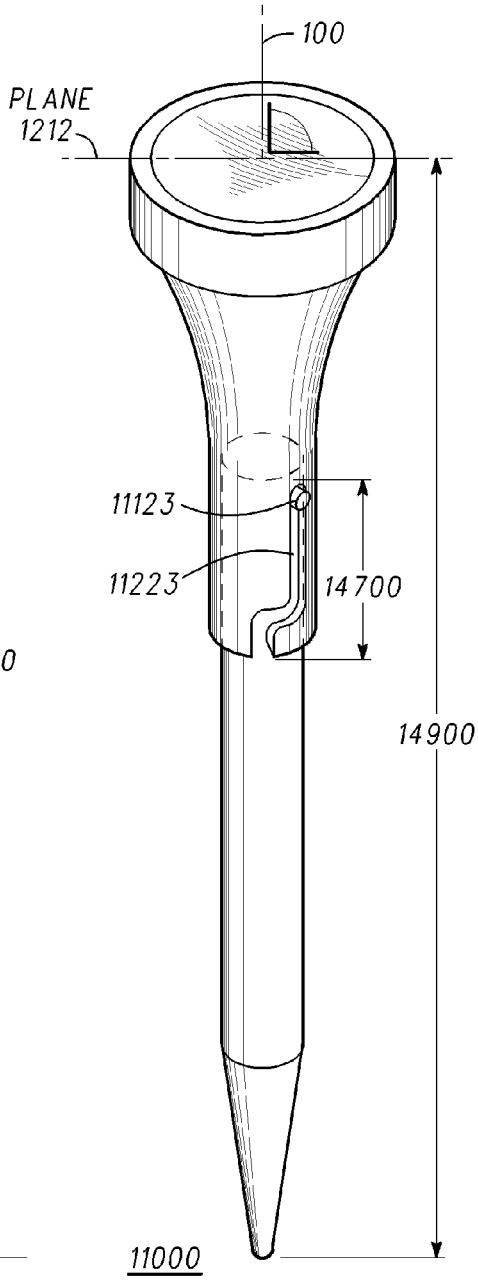
FIG. 14 illustrates a side view of the golf tee of FIG. 11 in a compressed configuration.

Continuing with the figures, FIG. 11 illustrates an exploded view of golf tee 11000, which is a different embodiment of golf tee 1000 of FIGS. 1-3. FIG. 12 illustrates a cross-sectional view of portion 11200 of golf tee 11000 of FIG. 11, taken along a section line 12-12 in FIG. 11. FIG. 13 illustrates a side view of golf tee 11000 of FIG. 11 in a relaxed configuration. FIG. 14 illustrates a side view of golf tee 11000 of FIG. 11 in a compressed configuration.

As illustrated in FIG. 11, golf tee 11000 comprises portion 11100 and portion 11200, which can be similar to portion 1100 and portion 1200, respectively, of golf tee 1000 from FIGS. 1-3. Portion 11100 comprises section 11120 and base section 11110, which can be similar to coupling section 1120 and base section 1110, respectively, of golf tee 1000 from FIGS. 1-3. Portion 11200 comprises section 11220 and support section 11210, which can be similar to coupling section 1220 and support section 1210, respectively, of golf tee 1000 from FIGS. 1-3.

Golf tee 11000 also comprises longest dimension 13500 (FIG. 13), height 13900 (FIG. 13), height 14900 (FIG. 14), displacement distance 13800 (FIG. 13), overlap distance 13700 (FIG. 13), and overlap distance 14700 (FIG. 14). These elements can be similar in function to longest dimension 1500, height 1900, height 3900, displacement distance 1800, overlap distance 1700, and overlap distance 3700, respectively, as described for golf tee 1000 from FIGS. 1-3. Golf tee 11000 can also have an intermediate height and an intermediate overlap, which can be similar to height 2900 and overlap distance 2700 of golf tee 1000 in FIG. 2.

In one embodiment, golf tee 11000 may also comprise a compressible material, which can be similar to compressible material 1400 of golf tee 1000 from FIGS. 1-3, or golf tee 11000 can be devoid of a compressible material and rely on friction. In addition, golf tee 11000 comprises axis 100 and plane 1212, as described for golf tee 1000 from FIGS. 1-3.

Golf tee 11000 is also capable of attaining a relaxed configuration as illustrated in FIG. 13, a semi-compressed configuration (not shown), and a compressed configuration as illustrated in FIG. 14. These configurations can be similar in function, respectively, to the relaxed configuration illustrated in FIG. 1, the semi-compressed configuration illustrated in FIG. 2, and the compressed configuration illustrated in FIG. 3, for golf tee 1000.

Finally, golf tee 11000 can also be capable of supporting a golf ball over a golf-playing surface as the golf ball is struck by a golf club in a manner similar to what was described earlier with reference FIG. 3. Golf tee 11000 is capable of reacting to a weight of the golf ball, and to forces exerted upon it when the golf club strikes the golf ball, in similar fashion as described for golf tee 1000 of FIGS. 1-3.

Golf tee 11000 differs from golf tee 1000. In particular, as illustrated in FIG. 11, section 11120 of portion 11100 comprises shaft 11121 with outer perimeter 11122, and also comprises stub 11123 at outer perimeter 11122 of shaft 11121.

As illustrated in FIGS. 11-12, section 11220 of portion 11200 comprises wall 11221 with inner perimeter 11222, slide slot 11223 at inner perimeter 11222 of wall 11221, and locking mechanism 11224 coupled to slide slot 11223. FIG. 12 illustrates wall 11221 and inner perimeter 11222 in greater detail, as viewed from cross-section line 12-12 in FIG. 11.

In the present embodiment of FIGS. 11-14, locking mechanism 11224 includes retainer slot 11225 extending from the bottom of section 11220 to slide slot 11223. Retainer slot 1125 is designed to guide stub 11123 of section 11120 to slide slot 11223, and to keep stub 11123 within slide slot 11223 after portion 11100 and portion 11200 are coupled together. In the illustrated embodiment, slide slot 11223 and retainer slot 11225 extend completely through wall 11221. In a different embodiment, slide slot 11223 and/or retainer slot 11225 can extend into inner perimeter 11222 and not be visible at an outer perimeter of wall 11221. In the illustrated embodiment, slide slot 11223 is substantially parallel to axis 100, but in a different embodiment, can be diagonal or otherwise non-parallel to axis 100. In the same or different embodiment, golf tee 11000 can include more than one set of slide slot 11223, retainer slot 11225, and stub 11123. For example, golf tee 11000 can have two of such sets, with the second set located at the opposite side of golf tee 11000.

FIGS. 13-14 show portion 11100 and portion 11200 coupled together. Inner perimeter 11222 of wall 11221 at portion 11200 is complementary to, and can surround, outer perimeter 11122 of shaft 11121 at portion 11100. The complementary interaction between inner perimeter 11222 and outer perimeter 11122 serves to guide portion 11200 along axis 100 when it moves relative to portion 11100. In addition, when portion 11100 and portion 11200 are coupled together, stub 11123 of section 11120 is engaged within slide slot 11223 of section 11220.

While golf tee 11000 is in the relaxed configuration, as shown in FIG. 13, locking mechanism 11224 of portion 11200 latches stub 11123 of portion 11100 to inhibit support section 11210 from moving further away from base section 11110, thus keeping portion 11200 and portion 11100 coupled together.

As golf tee 11000 moves towards the compressed configuration, portion 11200 slides towards portion 11100 along axis 100, guided by stub 11123 as engaged within slide slot 11223. The compressed configuration is illustrated in FIG. 14.

Upon reaching the compressed configuration, golf tee 11000 will exhibit height 14900, as illustrated in FIG. 14. Height 14900 is less than height 13900 exhibited by golf tee 11000 when in the relaxed configuration (FIG. 13). Portion 11200 will also have traversed up to displacement distance 13800 along axis 100 towards portion 11100 as golf club tee 11000 moves from the relaxed configuration to the compressed configuration. The overlap between portions 11100 and 11200 also increases from overlap distance 13700 (FIG. 13) to overlap distance 14700 (FIG. 14), as golf tee 11000 moves from the relaxed configuration to the compressed configuration.

Figure 15:
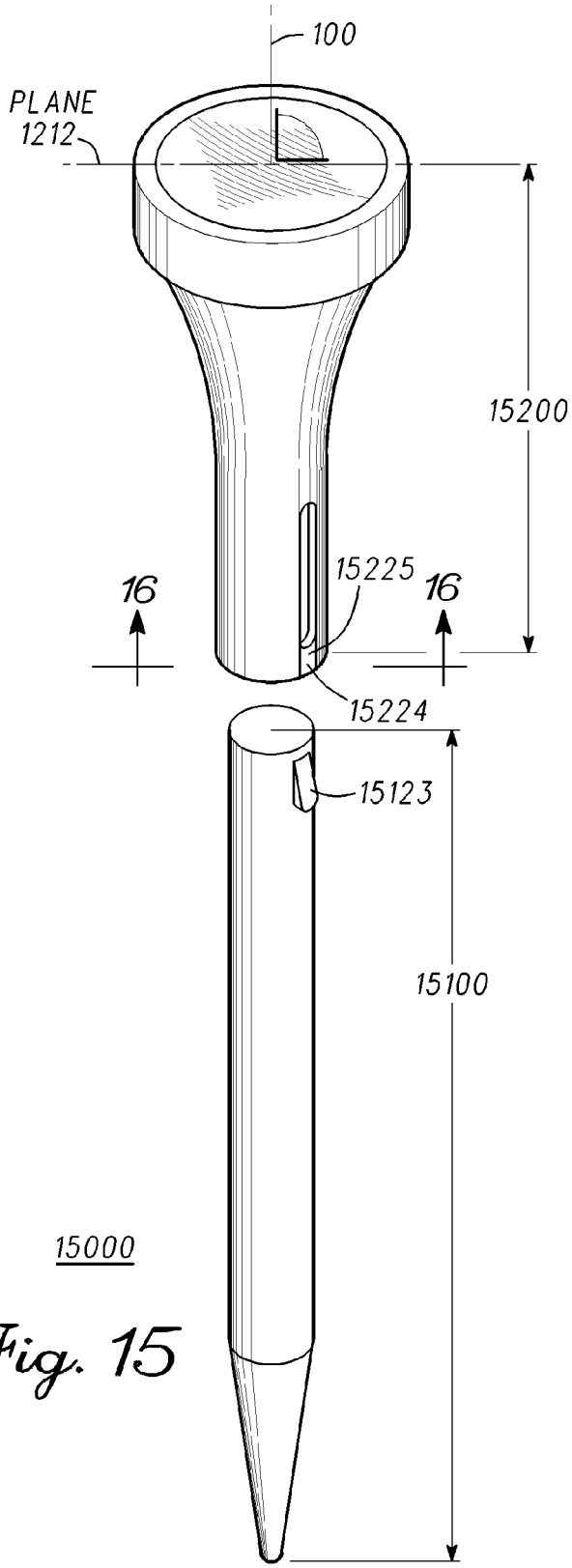
FIG. 15 illustrates an exploded view of a golf tee, which is another embodiment of the golf tee of FIGS. 1-3.
Figure 16:
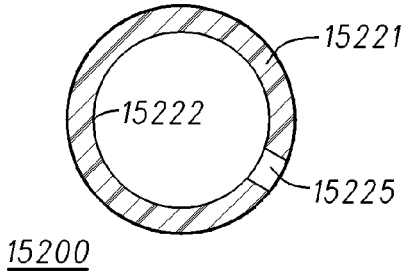
FIG. 16 illustrates a cross-sectional view of a second portion of the golf tee of FIG. 15, taken along a section line 16-16 in FIG. 15.
Figure 17:
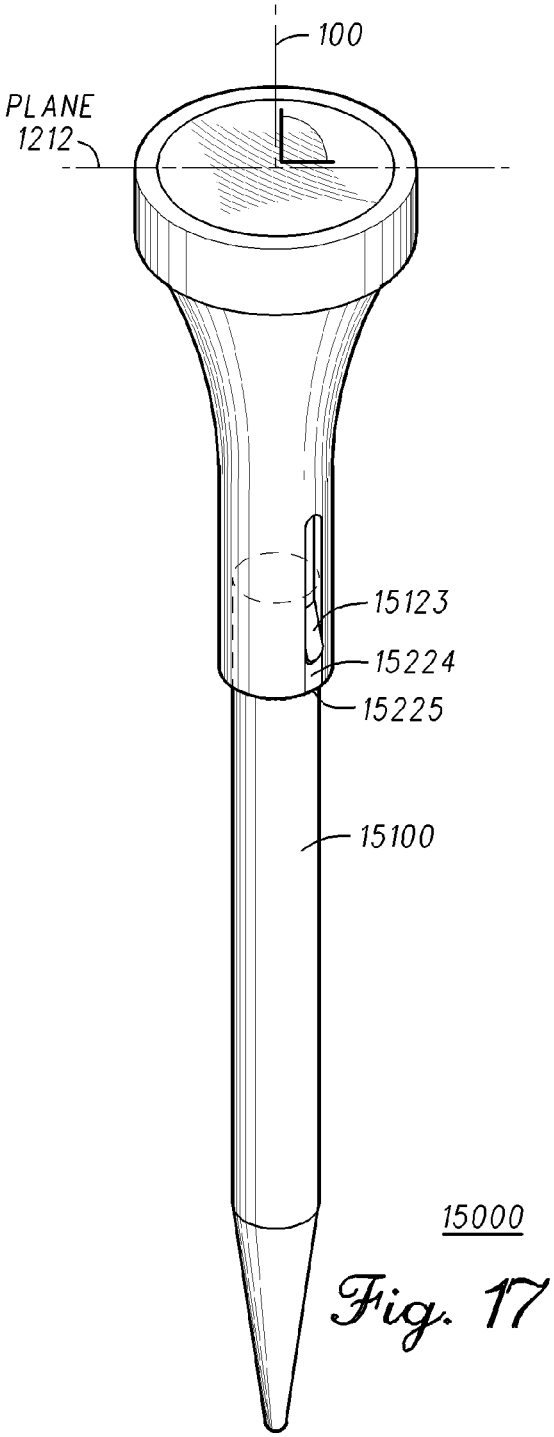
FIG. 17 illustrates a side view of the golf tee of FIG. 15 in a relaxed configuration.
Figure 18:
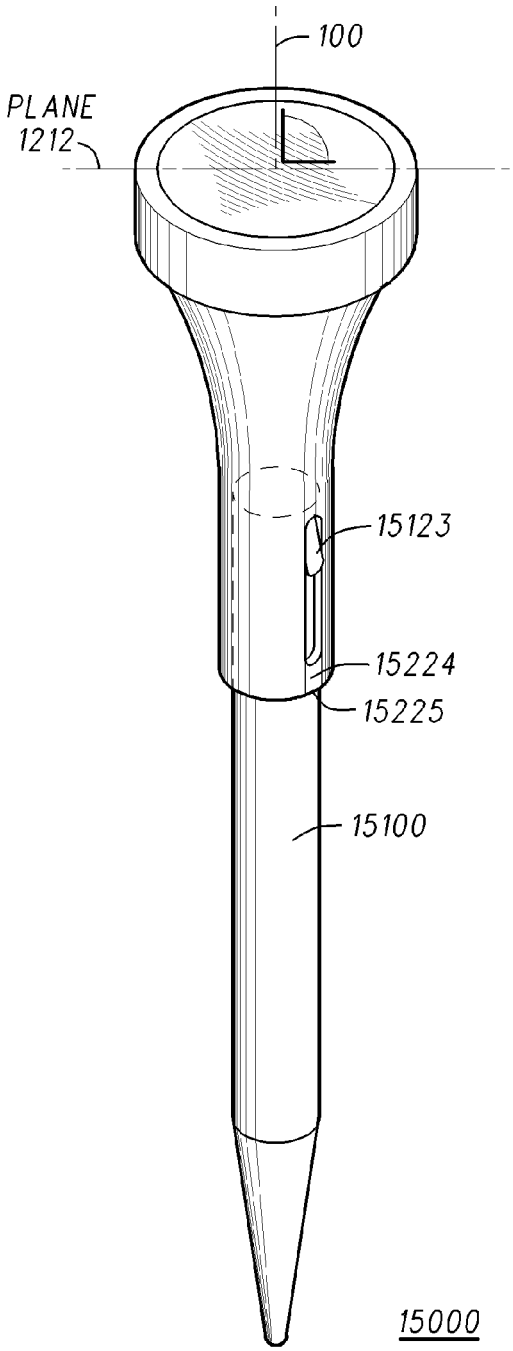
FIG. 18 illustrates a side view of the golf tee of FIG. 15 in a compressed configuration.

FIG. 15 illustrates an exploded view of golf tee 15000, which is a different embodiment of golf tee 1000 of FIGS. 1-3 and of golf tee 11000 of FIGS. 11-14. FIG. 16 illustrates a cross-sectional view of portion 15200 of golf tee 15000 of FIG. 15, taken along a section line 16-16 in FIG. 15. FIG. 17 illustrates a side view of golf tee 15000 of FIG. 15 in a relaxed configuration. FIG. 18 illustrates a side view of golf tee 15000 of FIG. 15 in a compressed configuration.

Golf tee 15000 of FIGS. 15-18 can be similar to golf tee 11000 of FIGS. 11-14. However, locking mechanism 15224 at portion 15200 of golf tee 15000 differs from locking mechanism 11224 of golf tee 11000 in FIGS. 11-14. Locking mechanism 15224 in FIG. 15 comprises tab 15225 forming part of inner perimeter 15222 of wall 15221 of portion 15200. Tab 15225, however, can be similar to retainer slot 11225 because tab 15225 is designed to latch stub 15123 on portion 15100 and to prevent portions 15100 and 15200 from moving apart when portions 15100 and 15200 are coupled together. In one embodiment, stub 15123 can be a fixed stub, and in another embodiment, stub 15123 can be a spring-loaded mechanism that can be pushed in towards the center of portion 15100 of golf tee 15000.

Figure 19:
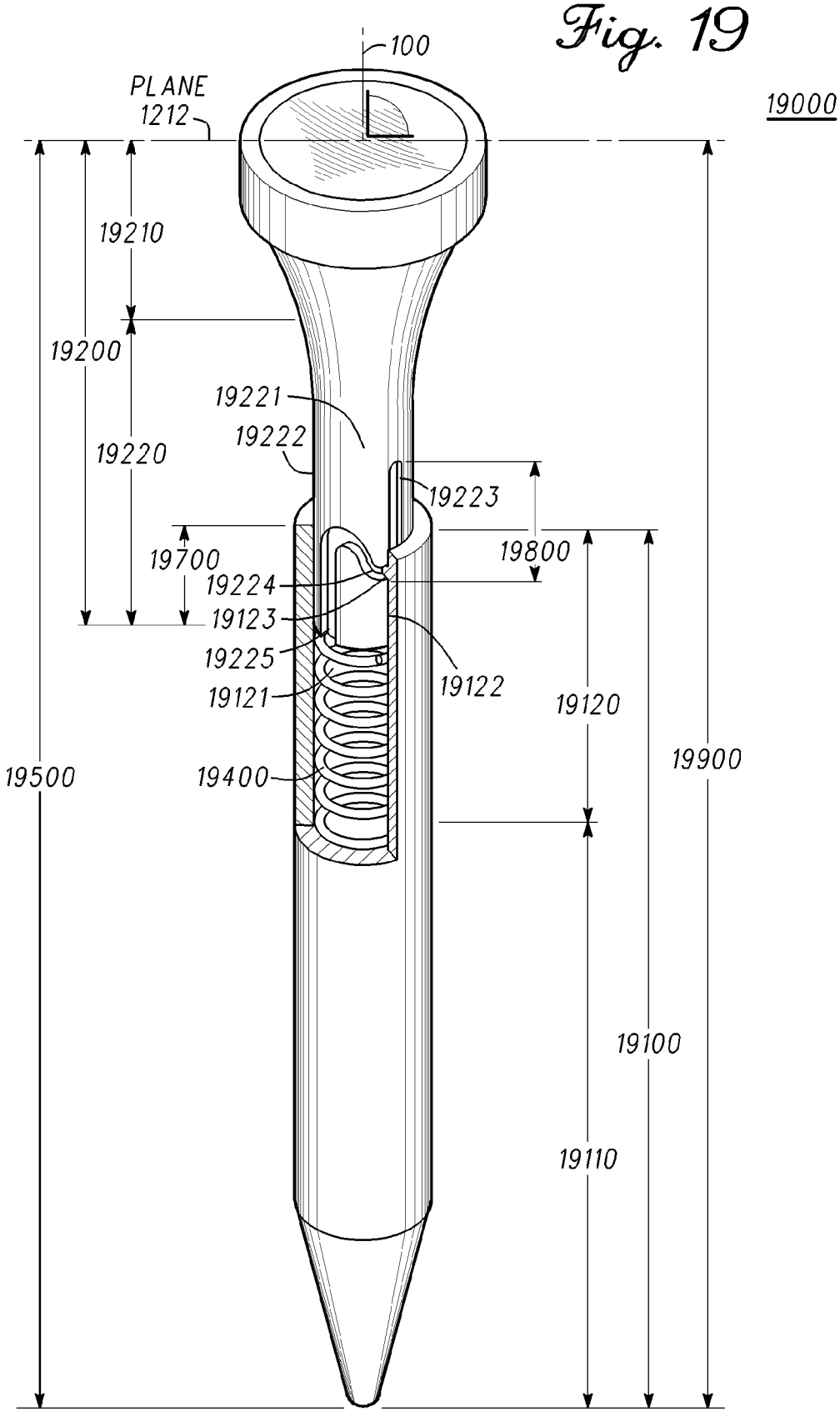
FIG. 19 illustrates a partial cross-sectional view of a golf tee, which is a yet another embodiment of the golf tee of FIGS. 1-3, in a relaxed configuration.
Figure 20:
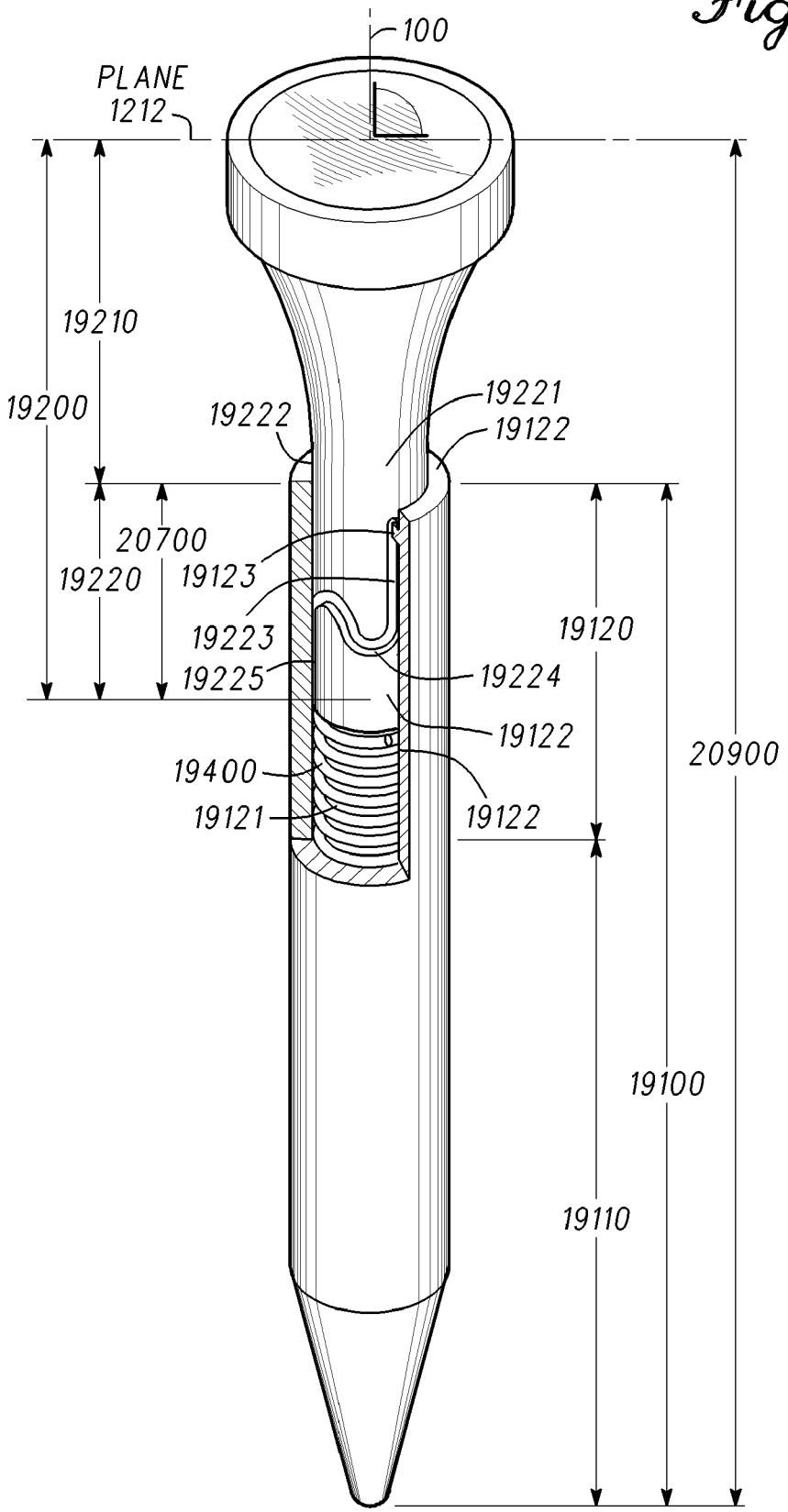
FIG. 20 illustrates a side view of the golf tee of FIG. 19 in a compressed configuration.

Continuing with the figures, FIG. 19 illustrates a partial cross-sectional view of golf tee 19000 in a relaxed configuration. Golf tee 19000 is a different embodiment of golf tee 1000 from FIGS. 1-3. FIG. 20 illustrates a partial cross-sectional view of golf tee 19000 of FIG. 19 in a compressed configuration.

As illustrated in FIG. 19, golf tee 19000 comprises portion 19100 and portion 19200, which can be similar to portion 1100 and portion 1200, respectively, of golf tee 1000 from FIGS. 1-3. Portion 19100 comprises section 19120 and base section 19110, which can be similar in function to pairing section 1120 and base section 1110, respectively, of golf tee 1000 from FIGS. 1-3. Portion 19200 comprises section 19220 and support section 19210, which can be similar in function to paring section 1220 and support section 1210, respectively, of golf tee 1000 from FIGS. 1-3.

Golf tee 19000 from FIGS. 19-20 also comprises longest dimension 19500, height 19900, height 20900, displacement distance 19800, overlap distance 19700, and overlap distance 20700. These elements can be similar to longest dimension 1500, height 1900, height 3900, displacement distance 1800, overlap distance 1700, and overlap distance 3700, respectively, as described for golf tee 1000 from FIGS. 1-3. Golf tee 1900 can also have an intermediate height and an intermediate overlap, which can be similar to height 2900 and overlap distance 2700 for golf tee 1000 in FIG. 2.

In one embodiment, golf tee 19000 may also comprise compressible material 19400, which can be similar to compressible material 1400 of golf tee 1000 from FIGS. 1-3. In addition, golf tee 19000 comprises axis 100 and plane 1212, as described for golf tee 1000 from FIGS. 1-3. In an embodiment where golf tee 19000 is devoid of compressible material 19400, golf tee 19000 can use friction instead, as explained previously for golf tee 1000 in FIGS. 1-3.

Golf tee 19000 is also capable of attaining a relaxed configuration as illustrated in FIG. 19, a semi-compressed configuration (not shown), and a compressed configuration as illustrated in FIG. 20. These configurations can be similar in function, respectively, to the relaxed configuration illustrated in FIG. 1, the semi-compressed configuration illustrated in FIG. 2, and the compressed configuration illustrated in FIG. 3, for golf tee 1000.

Finally, golf tee 19000 is also capable of supporting a golf ball over a golf-playing surface as the golf ball is struck by a golf club in a manner similar to that described earlier for FIG. 3. Golf tee 19000 is capable of reacting to a weight of the golf ball, and to forces exerted upon it when the golf club strikes the golf ball, in similar fashion as described for golf tee 1000 of FIGS. 1-3.

Golf tee 19000 differs from golf tee 1000 with respect to various structural elements. As illustrated in FIG. 19, section 19120 of portion 19100 comprises bore 19121 that extends along axis 100 and comprises an inner perimeter 19122. Section 19120 also comprises stub 19123 that extends from inner perimeter 19122 towards axis 100.

Section 19220 of portion 19200 comprises shaft 19221 that extends along axis 100 and comprises inner perimeter 19222. Section 19220 also comprises slide slot 19223 located at outer perimeter 19222 of shaft 19221. In the illustrated embodiment, slide slot 19223 is substantially parallel to axis 100, but in a different embodiment, can be diagonal or otherwise non-parallel to axis 100. Also, section 19220 can be solid, instead of hollow, such that section 19220 has outer perimeter 19222, but not an inner perimeter.

Section 19220 also comprises locking mechanism 19224 coupled to slide slot 19223. In the present embodiment of FIGS. 19-20, locking mechanism 19224 is represented by an engagement slot 19225 extending from the bottom of section 19220 to slide slot 19223. Engagement slot 19225 is designed to guide stub 19123 of section 19120 to slide slot 19223, and to latch stub 19123 after portion 19100 and portion 19200 are coupled together. In the same or different embodiment, golf tee 19000 can include more than one set of slide slot 19223, engagement slot 19225, and stub 19123. For example, golf tee 19000 can include three sets of such elements, with each set spaced evenly around a perimeter of golf tee 19000.

FIGS. 19-20 show portion 19100 and portion 19200 coupled together. Inner perimeter 19122 of bore 19121 at portion 19100 is complementary to, and can surround, outer perimeter 19222 of shaft 19221 at portion 19200. The complementary interaction between inner perimeter 19122 and outer perimeter 19222 serves to guide portion 19200 along axis 100 when it moves relative to portion 19100. In addition, when portion 19100 and portion 19200 are coupled together, stub 19123 is also coupled to slide slot 19223.

While golf tee 19000 is in the relaxed configuration, as shown in FIG. 19, locking mechanism 19224 of portion 19200 latches stub 19123 of portion 19100 to inhibit support section 19210 from moving further away from base section 19110, thus keeping portion 19200 and portion 19100 coupled together.

As golf tee 19000 moves towards the compressed configuration, illustrated in FIG. 20, portion 19200 slides towards portion 19100 along axis 100, guided by stub 19123 as engaged within slide slot 19223, and by the complementary interaction between inner perimeter 19122 and outer perimeter 19222.

Upon reaching the compressed configuration, golf tee 19000 will exhibit height 20900, as illustrated in FIG. 20. Height 20900 is less than height 19900 exhibited by golf tee 19000 when in the relaxed configuration (FIG. 19). Portion 19200 will also have traversed up to displacement distance 19800 (FIG. 19) along axis 100 towards portion 19100 as golf club tee 19000 moves from the relaxed configuration to the compressed configuration. The overlap between portions 19100 and 19200 also increases from overlap distance 19700 (FIG. 19) to overlap distance 20700 (FIG. 20), as golf tee 19000 moves from the relaxed configuration to the compressed configuration.

Figure 21:
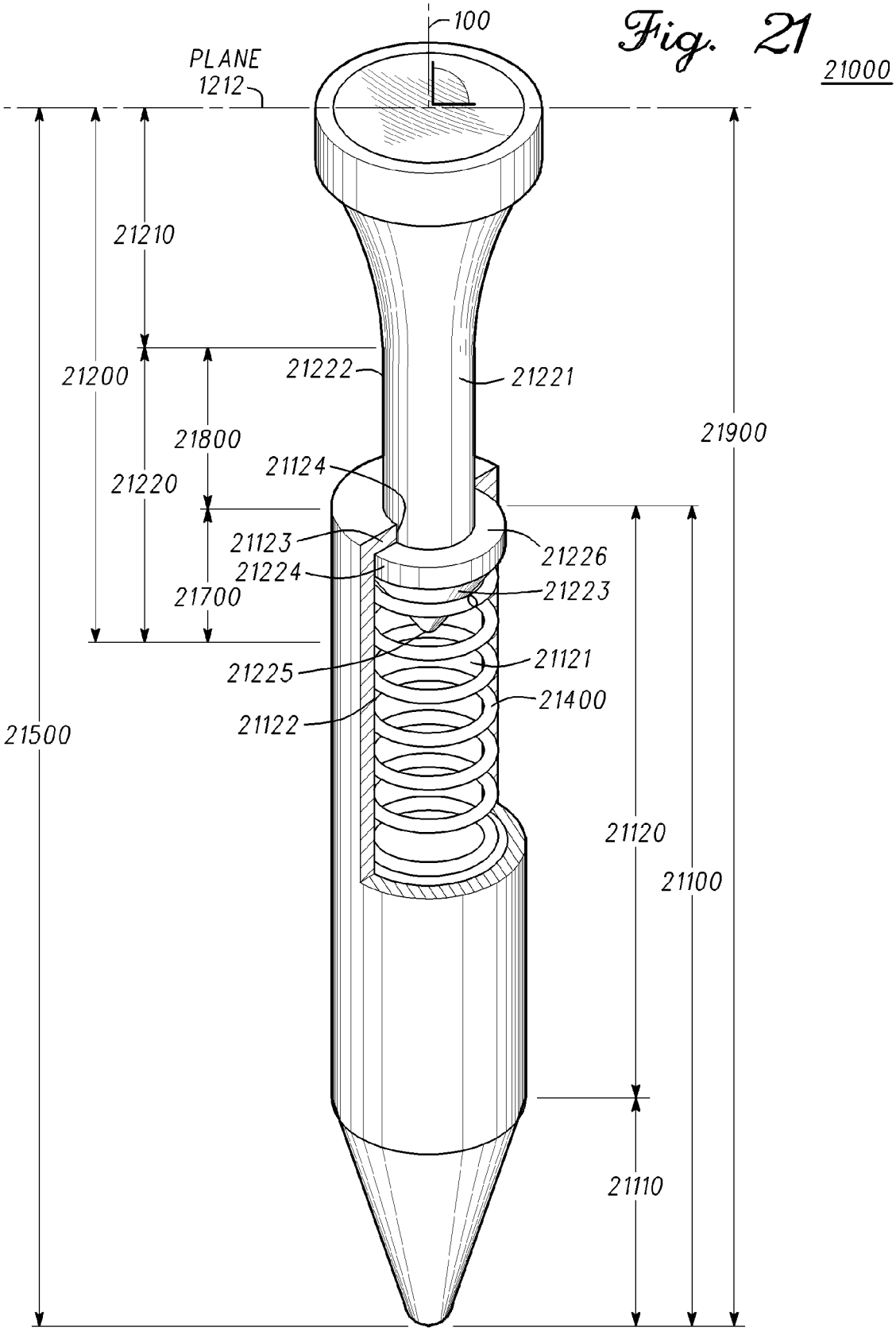
FIG. 21 illustrates a partial cross-sectional view of a golf tee, which is a further embodiment of the golf tee of FIGS. 1-3, in a relaxed configuration.
Figure 22:
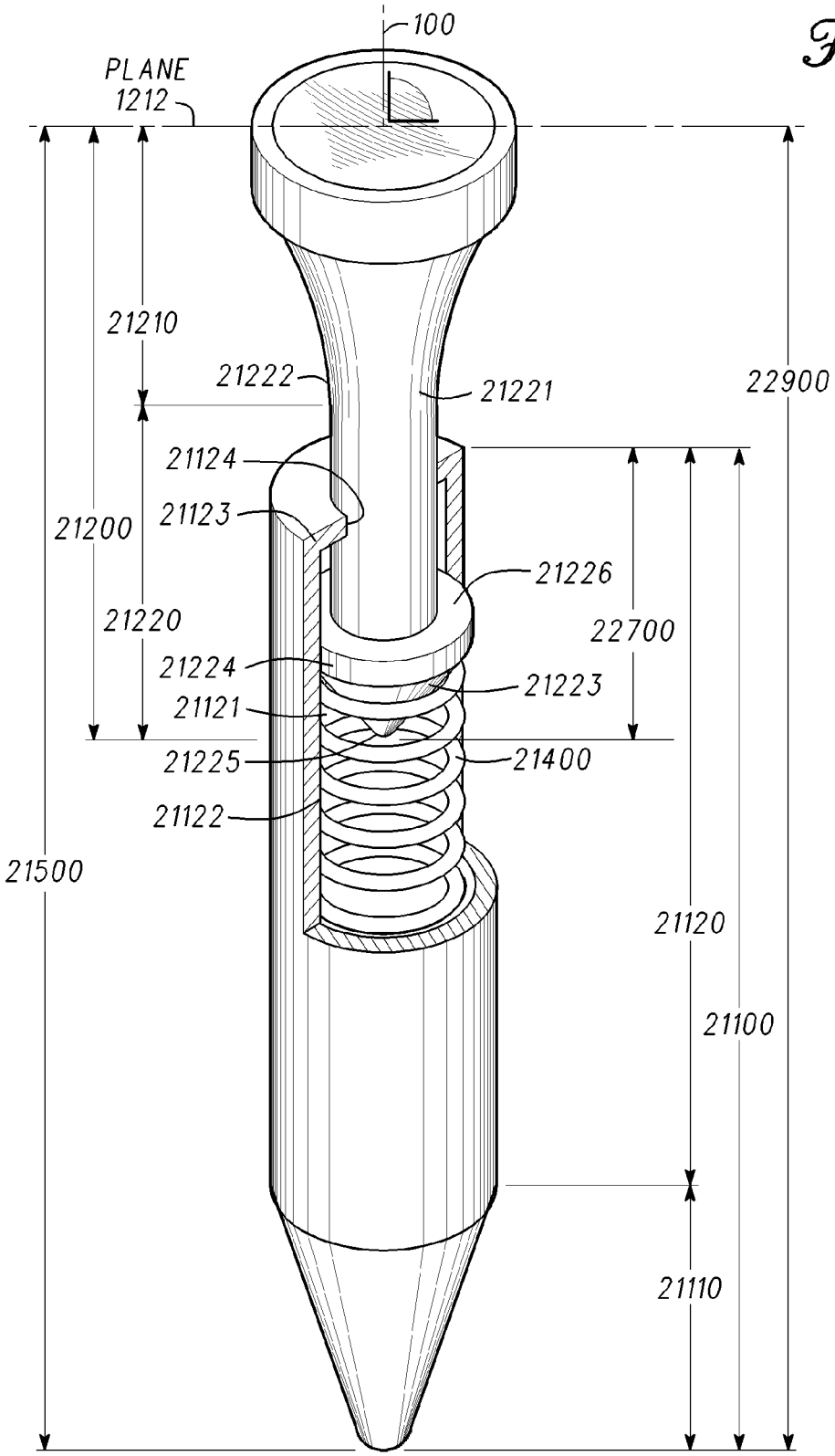
FIG. 22 illustrates a side view of the golf tee of FIG. 21 in a compressed configuration.

Continuing with the figures, FIG. 21 illustrates a partial cross-sectional view of golf tee 21000 in a relaxed configuration. Golf tee 21000 is a different embodiment of golf tee 1000 from FIGS. 1-3. FIG. 22 illustrates a partial cross-sectional view of golf tee 21000 of FIG. 21 in a compressed configuration.

As illustrated in FIG. 21, golf tee 21000 comprises portion 21100 and portion 21200, which can be similar to portion 1100 and portion 1200, respectively, of golf tee 1000 from FIGS. 1-3. Portion 21100 comprises section 21120 and base section 21110, which can be similar in function to pairing section 1120 and base section 1110, respectively, of golf tee 1000 from FIGS. 1-3. Portion 21200 comprises section 21220 and support section 21210, which can be similar in function to pairing section 1220 and support section 1210, respectively, of golf tee 1000 from FIGS. 1-3.

Golf tee 21000 from FIGS. 21-22 also comprises longest dimension 21500, height 21900, height 22900, displacement distance 21800, overlap distance 21700, and overlap distance 22700. These elements can be similar to longest dimension 1500, height 1900, height 3900, displacement distance 1800, overlap distance 1700, and overlap distance 3700, respectively, as described for golf tee 1000 from FIGS. 1-3. Golf tee 21000 can also have in intermediate height and an intermediate overlap, which can be similar to height 2900 and overlap distance 2700 of golf tee 1000 in FIG. 2.

In one embodiment, golf tee 21000 may also comprise compressible material 21400, which can be similar in function to compressible material 1400 of golf tee 1000 from FIGS. 1-3. In addition, golf tee 21000 comprises axis 100 and plane 1212, as described for golf tee 1000 from FIGS. 1-3. In an embodiment where golf tee 21000 is devoid of compressible material 21400, golf tee 21000 can use friction instead, as explained previously for golf tee 1000 in FIGS. 1-3.

Golf tee 21000 is also capable of attaining a relaxed configuration as illustrated in FIG. 21, a semi-compressed configuration (not shown), and a compressed configuration as illustrated in FIG. 22. These configurations can be similar in function, respectively, to the relaxed configuration illustrated in FIG. 1, the semi-compressed configuration illustrated in FIG. 2, and the compressed configuration illustrated in FIG. 3, for golf tee 1000.

Finally, golf tee 21000 is also capable of supporting a golf ball over a golf-playing surface as the golf ball is struck by a golf club in a manner similar to that described earlier for FIG. 3. Golf tee 21000 is capable of reacting to a weight of the golf ball, and to forces exerted upon it when the golf club strikes the golf ball, in similar fashion as described for golf tee 1000 of FIGS. 1-3.

Golf tee 21000 differs structurally from golf tee 1000 in FIG. 1. In particular, as illustrated in FIGS. 21-22, section 21120 of portion 21100 comprises bore 21121 that extends along axis 100 and comprises bore inner perimeter 21122. Section 21120 also comprises lip 21123 narrowing bore inner perimeter 21122 to lip inner perimeter 21124.

Section 21220 of portion 21200 comprises shaft 21221 that extends along axis 100 and comprises a shaft outer perimeter 21222. Section 21220 also comprises tip 21223, with tip outer perimeter 21224, at an end of shaft 21221. In the present embodiment, tip 21223 comprises pointed side 21225 and flat side 21226.

FIGS. 20-21 show portion 21100 and portion 21200 coupled together. In one embodiment, pointed side 21225 of tip 21223 can assist in coupling portion 21100 with portion 21200, allowing tip 21223 of section 21220 to be more easily inserted through lip inner perimeter 21124 of section 21120. As illustrated, tip outer perimeter 21224 is greater than shaft outer perimeter 21222. In particular, tip flat side 21226 extends substantially perpendicular to, and exceeds a thickness of, shaft 21221. In addition, bore inner perimeter 21122 of portion 21100 is complementary to tip outer perimeter 21224 of portion 21200. Finally, lip inner perimeter 21124 of portion 21100 is complementary to shaft outer perimeter 21222 of portion 21200.

While golf tee 21000 is in the relaxed configuration, as shown in FIG. 21, lip 21123 of portion 21100 engages tip flat side 21226 of portion 21200. This interaction inhibits support section 21210 from moving further away from base section 21110, thus keeping portion 21200 and portion 21100 coupled together.

As golf tee 21000 moves towards the compressed configuration, as illustrated in FIG. 22, portion 21200 slides towards portion 21100. This movement is guided along axis 100 by the complementary interaction between tip outer perimeter 21224 and bore inner perimeter 21122, and between lip inner perimeter 21124 and shaft outer perimeter 21222.

Upon reaching the compressed configuration, golf tee 21000 will exhibit height 22900, as shown in FIG. 22. Height 22900 is less than height 21900 exhibited by golf tee 21000 when in the relaxed configuration (FIG. 21). Portion 21200 can traverse up to displacement distance 21800 (FIG. 21) along axis 100 towards portion 21100 as golf tee 21000 moves from the relaxed configuration to the compressed configuration. The overlap between portions 21100 and 21200 also increases from overlap distance 21700 (FIG. 21) to overlap distance 22700 (FIG. 22), as golf tee 21000 moves from the relaxed configuration to the compressed configuration.

Figure 23:
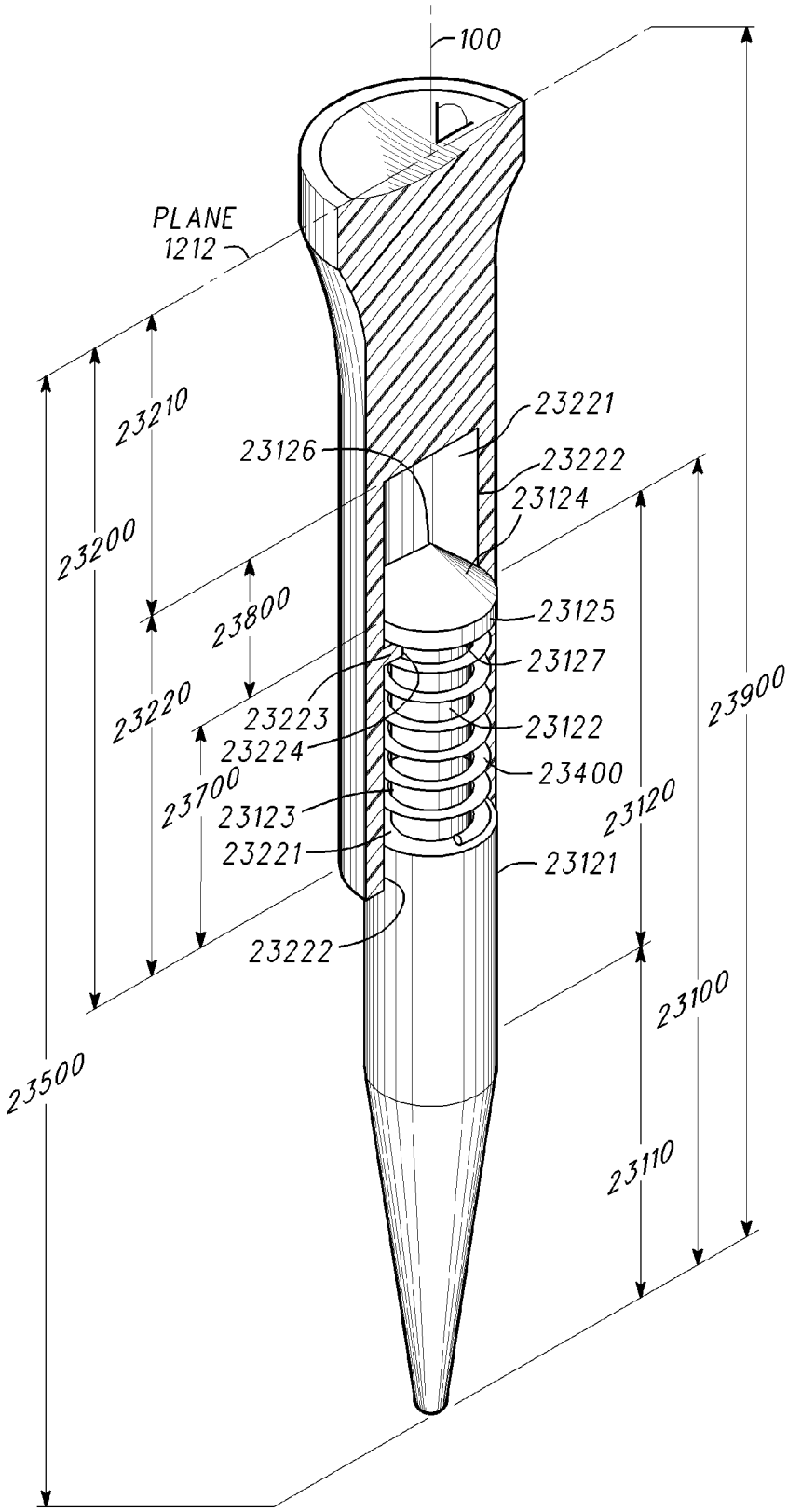
FIG. 23 illustrates a partial cross-sectional view of a golf tee, which is a different embodiment of the golf tee of FIGS. 1-3, in a relaxed configuration.
Figure 24:
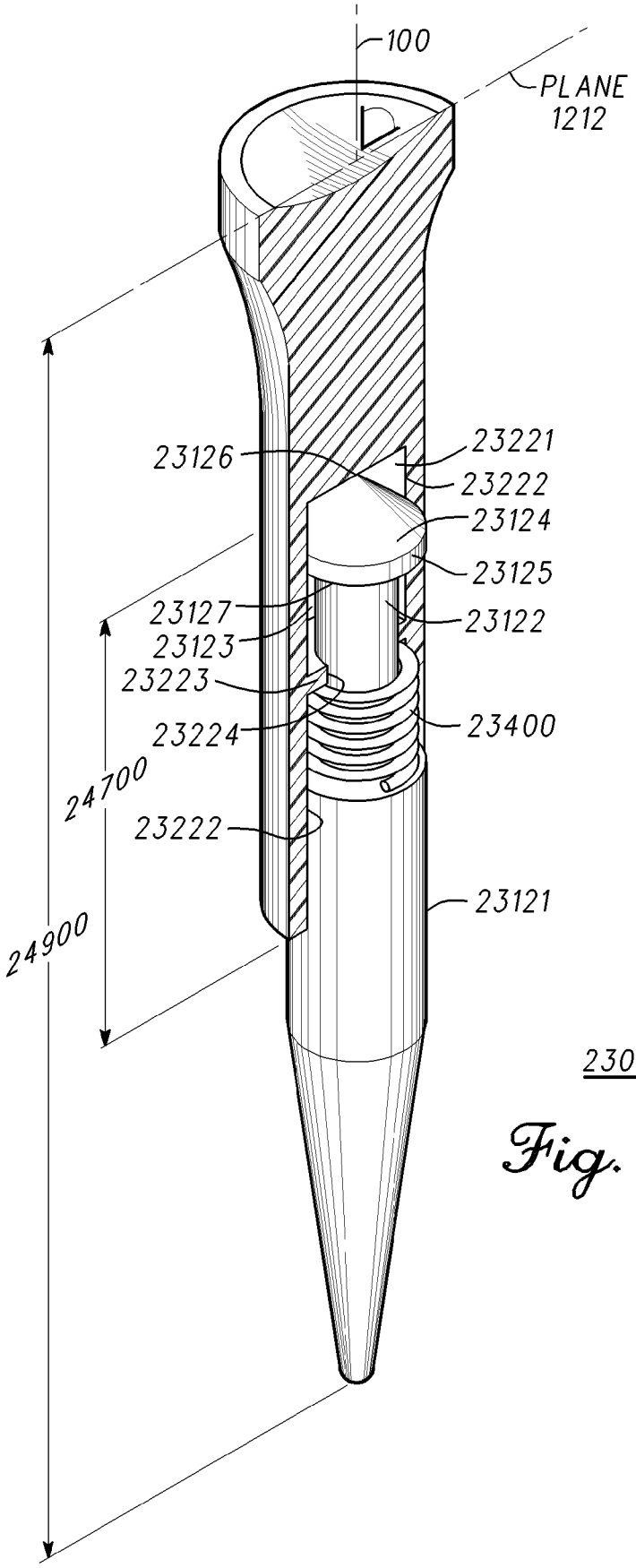
FIG. 24 illustrates a partial cross-sectional view of the golf tee of FIG. 23 in a compressed configuration.

Continuing with the figures, FIG. 23 illustrates a partial cross-sectional view of golf tee 23000 in a relaxed configuration. Golf tee 23000 is a different embodiment of golf tee 1000 from FIGS. 1-3. FIG. 24 illustrates a partial cross-sectional view of golf tee 23000 of FIG. 23 in a compressed configuration.

As illustrated in FIG. 23, golf tee 23000 comprises portion 23100 and portion 23200, which can be similar to portion 1100 and portion 1200, respectively, of golf tee 1000 from FIGS. 1-3. Portion 23100 comprises section 23120 and base section 23110, which can be similar in function to pairing section 1120 and base section 1110, respectively, of golf tee 1000 from FIGS. 1-3. Portion 23200 comprises section 23220 and support section 23210, which can be similar in function to pairing section 1220 and support section 1210, respectively, of golf tee 1000 from FIGS. 1-3.

Golf tee 23000 from FIGS. 23-24 also comprises longest dimension 23500, height 23900, height 24900, displacement distance 23800, overlap distance 23700, and overlap distance 24700. These elements can be similar to longest dimension 1500, height 1900, height 2900, height 3900, displacement distance 1800, overlap distance 1700, overlap distance 2700, and overlap distance 3700, respectively, as described for golf tee 1000 from FIGS. 1-3.

In one embodiment, golf tee 23000 may also comprise compressible material 23400, which can be similar to compressible material 1400 of golf tee 1000 from FIGS. 1-3. In addition to these structures and elements, golf tee 23000 comprises axis 100 and plane 1212, as described for golf tee 1000 from FIGS. 1-3. In an embodiment where golf tee 23000 is devoid of compressible material 23400, golf tee 23000 can use friction instead, as explained previously for golf tee 1000 in FIGS. 1-3.

Golf tee 23000 is also capable of attaining a relaxed configuration as illustrated in FIG. 23, a semi-compressed configuration (not shown), and a compressed configuration as illustrated in FIG. 24. These configurations can be similar in function, respectively, to the relaxed configuration illustrated in FIG. 1, the semi-compressed configuration illustrated in FIG. 2, and the compressed configuration illustrated in FIG. 3, for golf tee 1000.

Finally, golf tee 23000 is also capable of supporting a golf ball over a golf-playing surface as the golf ball is struck by a golf club in a manner similar to what was described earlier for FIG. 3. Golf tee 23000 is capable of reacting to a weight of the golf ball, and to forces exerted upon it when the golf club strikes the golf ball, in similar fashion as described for golf tee 1000 of FIGS. 1-3.

Golf tee 23000 differs from golf tee 1000 because, as illustrated in FIGS. 23-24, section 23120 of portion 23100 comprises section outer perimeter 23121, rod 23122 that extends along axis 100 and comprises rod outer perimeter 23123, and tip 23124, with tip outer perimeter 23125, at an end of rod 23122. In the present embodiment, tip 23124 comprises tip pointed side 23126 and tip flat side 23127.

Section 23220 of portion 23200 comprises bore 23221 that extends along axis 100 and comprises bore inner perimeter 23222. Section 23220 also comprises lip 23223 narrowing bore inner perimeter 23222 to lip inner perimeter 23224.

FIGS. 23-24 show portion 23100 and portion 23200 coupled together. In one embodiment, tip pointed side 23126 can assist in coupling portion 23100 with portion 23200, allowing tip 23124 of section 23120 to be more easily inserted through lip inner perimeter 23224 of section 23220.

As illustrated, tip outer perimeter 23125 is greater than rod outer perimeter 23123. In particular, tip flat side 23127 extends perpendicular to, and exceeds a thickness of, rod 23122. In addition, section outer perimeter 23121 is greater than rod outer perimeter 23123. Bore inner perimeter 23222 is complementary to section outer perimeter 23121, and lip inner perimeter 23224 is complementary to rod outer perimeter 23123. In the present embodiment, bore inner perimeter 23222 is also complementary to tip outer perimeter 23125.

While golf tee 23000 is in the relaxed configuration, as shown in FIG. 23, lip 23223 of portion 23200 engages tip flat side 23127 of portion 23100 to inhibit support section 23210 from moving further away from base section 23110, thus keeping portion 23200 and portion 23100 coupled together.

As golf tee 23000 moves towards the compressed configuration, portion 23200 slides towards portion 23100 along axis 100, guided by the complementary interaction between bore inner perimeter 23222 and section outer perimeter 23121, the complementary interaction between lip inner perimeter 23224 and rod outer perimeter 23123, and in the present embodiment, the complementary interaction between bore inner perimeter 23222 and tip outer perimeter 23125. The compressed configuration is illustrated in FIG. 24.

Upon reaching the compressed configuration, golf tee 23000 will exhibit height 24900, as shown in FIG. 24. Height 24900 is less than height 23900 exhibited by golf tee 23000 when in the relaxed configuration (FIG. 23). Portion 23200 will also have traversed up to displacement distance 23800 along axis 100 towards portion 23100 as golf club tee 23000 moves from the relaxed configuration to the compressed configuration. The overlap between portions 23100 and 23200 also increases from overlap distance 23700 (FIG. 23) to overlap distance 24700 (FIG. 24), as golf tee 23000 moves from the relaxed configuration to the compressed configuration.

Figure 25:
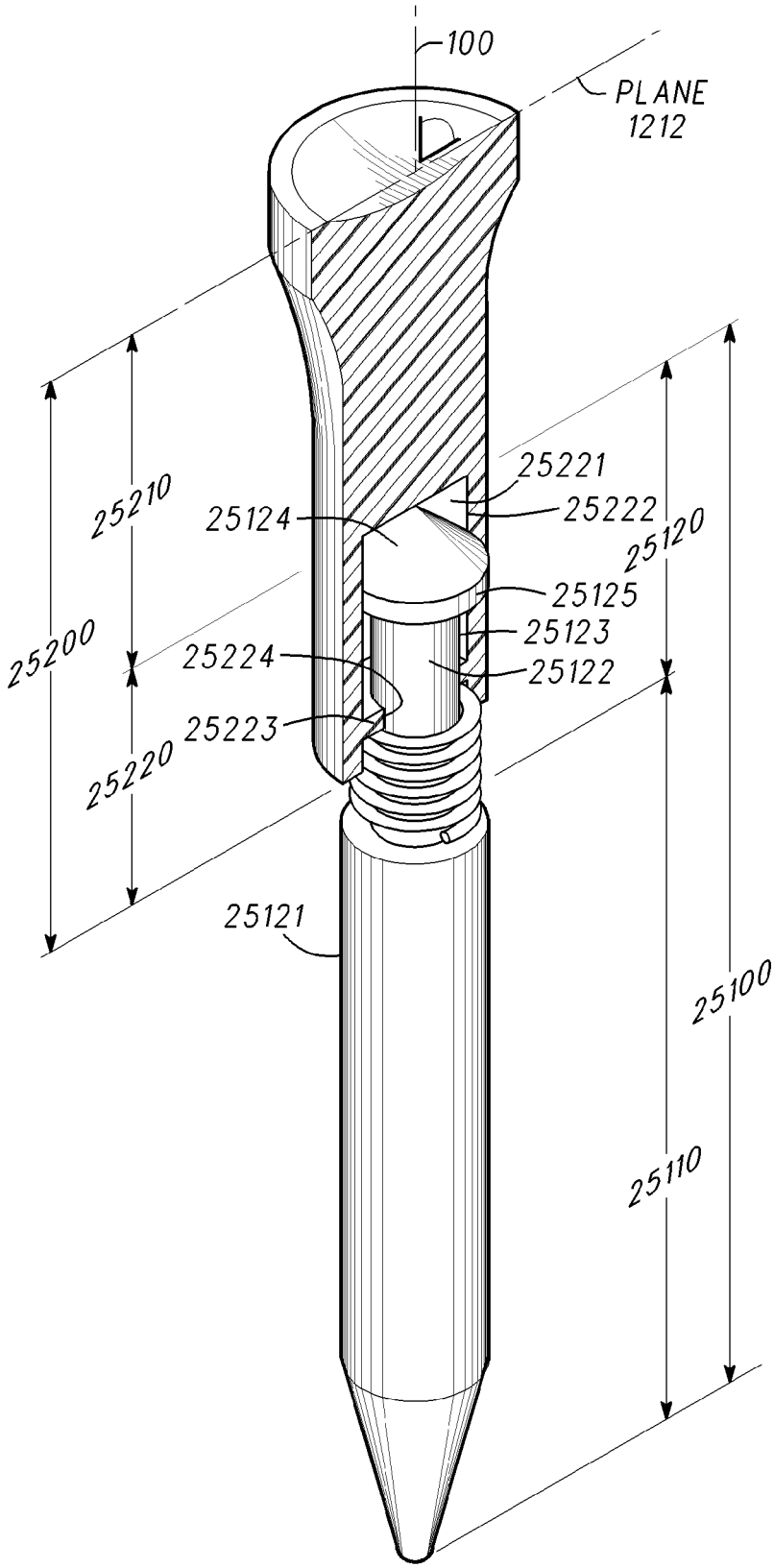
FIG. 25 illustrates a partial cross-sectional view of a golf tee, which is a further embodiment of the golf tee of FIGS. 1-3, in a compressed configuration.

FIG. 25 illustrates a partial cross-sectional view of golf tee 25000, which is a different embodiment of golf tee 1000 of FIGS. 1-3. Golf tee 25000 can also be similar to golf tee 23000 of FIGS. 23-24.

As illustrated in FIG. 25, golf tee 25000 comprises portion 25100 and portion 25200, which can be similar to portion 1100 and portion 1200, respectively, of golf tee 1000 from FIGS. 1-3. Portion 25100 comprises section 25120 and base section 25110, which can be similar to pairing section 1120 and base section 1110, respectively, of golf tee 1000 from FIGS. 1-3. Portion 25200 comprises section 25220 and support section 25210, which can be similar in function to pairing section 1220 and support section 1210, respectively, of golf tee 1000 from FIGS. 1-3.

Golf tee 25000 differs from golf tee 1000 (FIGS. 1-3) and golf tee 23000 (FIGS. 23-24). As illustrated in FIG. 25, section 25120 of portion 25100 comprises rod 25122 that extends along axis 100 and comprises rod outer perimeter 25123, and tip 25124, with tip outer perimeter 25125, at an end of rod 25122. In turn, section 25220 of portion 25200 comprises bore 25221 that extends along axis 100 and comprises bore inner perimeter 25222. Section 25220 also comprises lip 25223 narrowing bore inner perimeter 25222 to lip inner perimeter 25224.

FIG. 25 shows portion 25100 and portion 25200 coupled together. As illustrated, tip outer perimeter 25125 is greater than rod outer perimeter 25123. Bore inner perimeter 25222 is complementary to tip outer perimeter 25125, and lip inner perimeter 25224 is complementary to rod outer perimeter 25123.

Golf tee 25000 mainly differs from golf tee 23000 (FIGS. 23-24) in that bore 25221 does not extend to overlap, and is not complementary with, section outer perimeter 25121. Instead, section outer perimeter 25121 is greater than bore inner perimeter 25222. In operation, as golf tee 23000 moves towards the compressed configuration, illustrated in FIG. 25, portion 25200 slides towards portion 25100 along axis 100, guided by the complementary interaction between lip inner perimeter 25224 and rod outer perimeter 25123, and the complementary interaction between bore inner perimeter 25222 and tip outer perimeter 25125.

Figure 26:
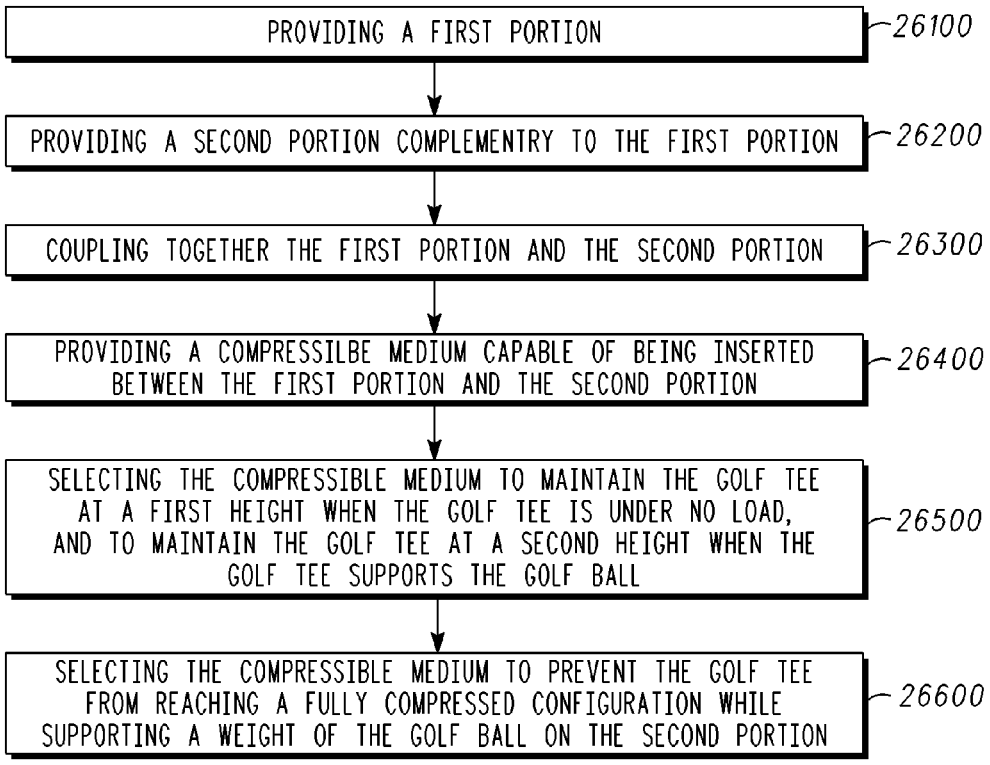
FIG. 26 illustrates a flow diagram representation of a method of manufacturing a golf tee, according to an additional embodiment.

Continuing with the figures, FIG. 26 illustrates a flowchart of method 26000 for manufacturing a golf tee. As an example, the golf tee in method 26000 can be golf tee 1000 in FIGS. 1-3, golf tee 4000 in FIGS. 4-8, golf tee 9000 in FIG. 9, golf tee 10000 in FIG. 10, golf tee 11000 in FIGS. 11-14, golf tee 15000 in FIGS. 15-18, golf tee 19000 in FIGS. 19-20, golf tee 21000 in FIGS. 21-22, golf tee 23000 in FIGS. 23-24, and/or golf tee 25000 in FIG. 25.

In method 26000, manufacturing the golf tee can comprise making the golf tee available to purchasers or users, for example, by the manufacturer of the golf tee, distributors, marketers, or resellers. The golf tee can be made available via wholesale distribution methods, and/or through retail networks that cater to midstream parties or end users.

Block 26100 of method 26000 in FIG. 26 involves providing a first portion of the golf tee. The first portion of the golf tee could be manufactured, for example, to provide a base to support the golf tee over a golf-playing surface. In one example, the first portion of the golf tee provided in block 26100 can be similar to portion 1100 of golf tee 1000 in FIG. 1, or any other similar portion for the other golf tees described above.

In one embodiment, the first portion of the golf tee provided in block 26100 can comprise a base section and a section opposite the base section. As an example, the base section of the portion provided in block 26100 can comprise a pointed shaft capable of being inserted into a golf-playing surface to provide support for the rest of the portion and the golf tee. The base section can be the base section of any of the golf tees described above, like base section 1110 in FIG. 1. In the same or a different example, the section opposite the base section provided in block 26100 can comprise a mechanism to couple with the rest of the golf tee of method 26000. The section can be similar to pairing section 1120 of golf tee 1000 in FIG. 1, or any other similar section for the other golf tees described above.

Block 26200 of method 26000 comprises providing a second portion complementary to the first portion of block 26100. The second portion of the golf tee could be manufactured, for example, to provide support for a golf ball on the golf tee. In one example, the portion of the golf tee provided in block 26200 can be similar to portion 1200 of golf club 1000 in FIG. 1, or any other similar portion for the other golf tees described above.

In one embodiment, the second portion of the golf tee provided in block 26200 can comprise a support section and a section opposite the support section. As an example, the support section of the second portion provided in block 26200 can be tailored to support a golf ball over the golf tee. The support section can be the support section of any of the golf tees described above, like support section 1210 in FIG. 1. In the same or a different example, the section opposite the support section provided in block 26200 can comprise a mechanism, complementary to the section of block 26100, to couple the rest of the golf tee of method 26000. The section can be the section of any of the golf tees described above, like pairing section 1220 in FIG. 1.

In the same embodiment, a perimeter of an end of the support section of the portion provided in block 26200 defines a plane. In one example, the perimeter can be perimeter 1211 in FIG. 1, or any similar perimeter for any of the golf tees described above. In the same or a different example, the plane remains substantially parallel to a golf playing surface when the golf tee is in use, and can be the plane of any of the golf tees described above, like plane 1212 in FIG. 1.

Block 26300 of method 26000 comprises coupling together the first portion of block 26100 and the second portion of block 26200. In one example, coupling the first portion and the second portion allows the second portion to move relative to the first portion while the plane described in block 26200 remains substantially perpendicular to an axis. The axis can be axis 100 from any of the golf tees described above. In addition, in the same or a different example, the first and second portions can be coupled together via the pairing sections described above for blocks 26100 and 26200, or as described for any of the golf tees described above.

Block 26400 of method 26000 involves providing a compressible medium capable of being inserted between the first portion of block 26100 and the second portion of block 26200. In one example, the compressible medium can be referred to as a compressible material, and can be as described for, and as located in, any of the golf tees described above, such as compressible material 1400 of FIG. 1.

Block 26500 of method 26000 involves selecting the compressible medium of block 26400 to maintain the golf tee at a second height when the golf tee supports a golf ball or when a weight of the golf ball acts upon the golf tee, and to maintain the golf tee at a first height greater than or equal to the second height when the golf tee is under no load. In a different example, the second height (or a third height) is attained when the golf ball pushes onto the golf tee while or after being struck by a golf club head. The first height can be similar to height 1900 of golf tee 1000 in FIG. 1, or any other similar height for the other golf tees described above. The second height can be similar to height 2900 of golf tee 1000 in FIG. 2 or height 3900 of golf tee 1000 in FIG. 3, or any other similar height for the other golf tees described above.

Finally, in one example, block 26600 of method 26000 comprises selecting the compressible medium to prevent the golf tee from reaching a fully compressed configuration while supporting a weight of the golf ball on the second portion before the golf ball is struck by a golf club. In one example, the compressible medium can compress as it resists the movement of the second portion provided in block 26200 onto the first portion provided in block 26100. The compressible medium may be rigid enough to support the weight of the golf ball while compressing a minimal distance, such that the golf tee may further compress towards the compressed configuration when a force greater than the weight of the golf ball acts upon the golf tee. In one example, the compressed configuration can be the compressed configuration of any of the golf tees described above, such as the compressed configuration depicted in FIG. 3 for golf tee 1000.

In one embodiment, blocks 26100, 26200, 26300, 26400, 26500, and 26600 of method 26000 can be subparts of a single step, and/or their sequence can be otherwise changed. For example, in one embodiment, block 26400 is performed between blocks 26200 and 26300.

Figure 27:
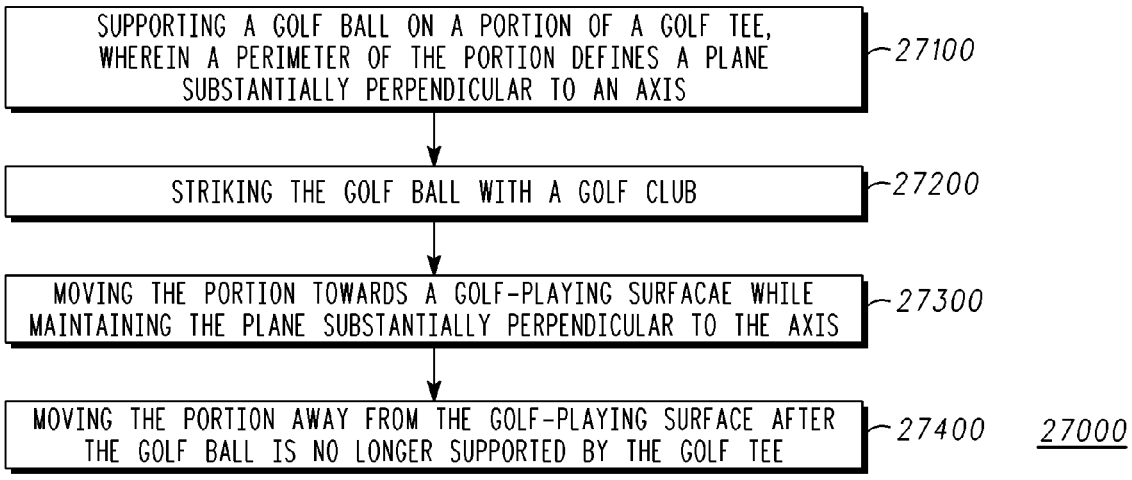
FIG. 27 illustrates a flow diagram representation of a method of operating a golf tee, according to another embodiment.

Continuing with the figures, FIG. 27 illustrates a flowchart of a method 27000 for operating a golf tee. As an example, the golf tee in method 27000 can be golf tee 1000 in FIGS. 1-3, golf tee 4000 in FIGS. 4-8, golf tee 9000 in FIG. 9, golf tee 10000 in FIG. 10, golf tee 11000 in FIGS. 11-14, golf tee 15000 in FIGS. 15-18, golf tee 19000 in FIGS. 19-20, golf tee 21000 in FIGS. 21-22, golf tee 23000 in FIGS. 23-24, and/or golf tee 25000 in FIG. 25.

Block 27100 of method 27000 involves supporting a golf ball on a portion of the golf tee. In one embodiment, the portion of the golf tee of block 27100 can be similar to portion 1200 of golf tee 1000 in FIG. 1, or any other similar portion for the other golf tees described above. In one example, part of block 27100 can comprise inserting the golf tee into a golf playing surface, such as illustrated in FIG. 1. Similarly, the portion of the golf tee of block 27100 can support the golf ball as illustrated, for example, in FIG. 2.

In addition, for block 27100, a perimeter of the portion of the golf tee defines a plane substantially perpendicular to an axis. In one example, the perimeter can be perimeter 1211 in FIG. 1, or any similar perimeter for any of the golf tees described above. In the same or a different example, the plane defined by the perimeter is maintained substantially parallel to a golf playing surface when the golf tee is in use, and can be similar to the plane of any of the golf tees described above, like plane 1212 in FIG. 1. In the same or a different example, the axis can be axis 100 from any of the golf tees described above.

A block 27200 of method 27000 involves striking the golf ball supported by the golf tee of block 27100 with a golf club. As an example, striking the golf ball with the golf club can be as depicted in FIG. 3 for any of the golf tees described above.

In one embodiment of block 27200, striking the golf ball with the golf ball comprises moving the portion of the golf tee towards a golf playing surface as the golf ball is supported by the portion of the golf tee. As an example, the golf club striking the golf ball may cause the golf ball to expand against the portion of the golf tee, or to otherwise exert a force onto the portion of the golf tee, as illustrated in FIG. 3 for golf tee 1000. Such a force exerted upon the portion of the golf tee in block 27200 can cause the portion to move, with respect to the rest of the golf tee, towards the golf playing surface. In the same or a different example, moving the portion towards the golf playing surface is automatic once the golf club strikes the golf ball in block 27000.

A block 27300 of method 27000 comprises moving the portion of the golf tee towards a golf-playing surface while maintaining the plane substantially perpendicular to the axis. In one embodiment for block 27300, the portion of the golf tee is coupled to the golf tee via complementary mechanisms, such as pairing section 1120 and pairing section 1220 of golf tee 1000 in FIG. 1, or any other similar sections for the other golf tees described above. As the portion of the golf tee moves towards the golf-playing surface, such as while the golf ball pushes onto the portion of the golf tee as described for block 27200, the complementary mechanisms interact with each other to maintain the plane, as defined by the perimeter of the portion, substantially perpendicular to the axis described in block 27100.

Block 27400 of method 27000 comprises moving the portion away from the golf-playing surface after the golf ball is no longer supported by the portion of the golf tee. In one embodiment, when the golf ball has left the portion of the golf tee after being struck by the golf club, as described in block 27200, no more load is exerted upon the portion of the golf tee, and the portion can be returned to its normal position with respect to the golf tee, such as by moving away from the golf playing surface. In one example, moving the portion of the golf tee away from the golf-playing surface is done manually, while in a different example it is done automatically, such as by the action of a compressible material against the portion of the golf tee. In such an example, the compressible material can be the compressible material for any of the golf tees described above, such as compressible material 1400 in FIG. 1.

In one example, blocks 27100, 27200, 27300, and 27400 of method 27000 can be subparts of a single step. In the same or a different example, the sequence of blocks 27100, 27200, 27300, and 27400 of method 27000 can be otherwise changed.

Although the golf tee and related methods have been described with reference to specific embodiments, it will be understood by those skilled in the art that various changes may be made without departing from the spirit or scope of the golf tee and related methods. Various examples of such changes have been given in the foregoing description. Accordingly, the disclosure of embodiments of the golf tee and related methods is intended to be illustrative of the scope of the application and is not intended to be limiting. It is intended that the scope of this application shall be limited only to the extent required by the appended claims. For example, to one of ordinary skill in the art, it will be readily apparent that the golf tee and related methods discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the golf tee and related methods, and may disclose alternative embodiments of the golf tee and related methods.

All elements claimed in any particular claim are essential to the golf tee or related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf tee to support a golf ball, comprising:
a first portion;
a second portion coupled to the first portion;
an axis along the first and second portions; and
a compressible material located between the first portion and the second portion;
wherein:
the golf tee comprises:
a compressed configuration when the golf tee is subjected to a load; and
a relaxed configuration when the load is removed;
the first portion comprises:
a base section with a ground-piercing end to support the golf tee; and
a first section opposite the base section;
the second portion comprises:
a support section to support the golf ball;
a second section opposite the support section; and
a perimeter of a support end of the support section defining a plane;
the second section of the second portion is coupled to the first section of the first portion;
the axis is substantially perpendicular to the plane;
the first and second portions are displaceable, relative to each other, along the axis;
the first and second portions are substantially non-tiltable relative to each other;
the golf tee is transitioned from the relaxed configuration to the compressed configuration when the load moves the second portion towards the first portion; and
the compressible material is configured to:
increasingly compress along the axis as the golf tee is transitioned from the relaxed configuration to the compressed configuration; and
automatically return the golf tee to the relaxed configuration when the load is removed from the support end of the support section while the base section of the first portion remains inserted into a ground surface.

2. The golf tee of claim 1, wherein:
the first and second portions are substantially concentric to the axis; and
the first and second portions are substantially displaceable, relative to each other, only along the axis.

3. The golf tee of claim 1, wherein:
the load consists of a weight of the golf ball;
when the golf tee does not support the weight of the golf ball, the golf tee automatically has a first height;
when the golf tee supports the weight of the golf ball, the golf tee automatically has a second height; and
the first height is greater than the second height.

4. The golf tee of claim 1, wherein:
the first portion or the second portion comprises at least one of:
a metallic material, a wooden material, a nylon material, or a polypropylene material; and
the compressible material comprises at least one of:
a spring, a foam cushion, a urethane cushion, a sponge, a soft plastic, a magnetic mechanism, a body of air, or a gaseous cushion.

5. The golf tee of claim 1, wherein:
the load comprises an expansion force exerted by the golf ball when deformed upon impact with a strike face of a club;
the compressible material automatically maintains the golf tee at a first height when the golf tee supports a weight of the golf ball;
the second portion of the golf tee is displaced towards the first portion, such that the golf tee is at a second height, when the expansion force is exerted; and
the first height is greater than the second height.

6. The golf tee of claim 1, wherein:
the compressible material comprises a first degree of compressibility;
a second compressible material comprises a second degree of compressibility; and
the compressible material is interchangeable in the golf tee with the second compressible material.

7. The golf tee of claim 1, wherein:
the compressible material prevents the golf tee from reaching a fully compressed configuration while the golf tee supports the load; and
the load comprises at least one of:
a weight of the golf ball; or
an expansion force exerted by the golf ball when deformed upon impact with a strike face of a club.

8. The golf tee of claim 1, wherein:
the axis is substantially collinear with a length of the golf tee; and
the compressible material is increasingly compressed along the axis when the second portion is displaced towards the first portion.

9. The golf tee of claim 1, wherein:
the compressible material is located fully within the second portion; and
the compressible material is configured to be compressed by the second portion against the first portion when the support section supports the golf ball.

10. The golf tee of claim 1, wherein:
the first and second portions comprise a restrictor mechanism to restrict a separation of the first and second portions from each other;
wherein the restrictor mechanism comprises at least one of:
a stub, a bracket, a slot, a tab, or a lip.

11. The golf tee of claim 1, wherein:
the first section of the first portion further comprises:
a first tab; and
a bracket;
and
the second section of the second portion further comprises:
a first prong with a first wall;
a second prong with a second wall; and
a stub at the first prong;
wherein:
the first prong and the second prong extend substantially parallel to the axis;
the first wall of the first prong and the second wall of the second prong straddle the first tab and guide the second portion along the axis; and
the stub of the first prong couples to the bracket of the first portion to inhibit the support section from moving further away from the base section.

12. The golf tee of claim 1, wherein:
the first section of the first portion further comprises:
a shaft with an outer perimeter; and
a first stub at the outer perimeter of the shaft;
and
the second section of the second portion further comprises:
a wall with an inner perimeter;
a slide slot located at the inner perimeter of the wall; and
a locking mechanism coupled to the slide slot;
wherein:
the inner perimeter of the wall of the second portion is complementary to the outer perimeter of the shaft of the first portion to guide movement of the second portion along the axis;
the first stub is engaged within the slide slot; and
the locking mechanism of the second portion latches the first stub of the first portion to inhibit the support section from moving further away from the base section.

13. The golf tee of claim 12, wherein:
the locking mechanism comprises at least one of:
a tab forming part of the inner perimeter of the wall;
a retainer slot leading to the end of the slide slot.

14. The golf tee of claim 1, wherein:
the first section of the first portion further comprises:
a bore extending along the axis, with an inner perimeter; and
a stub at the inner perimeter of the first section;
and
the second section of the second portion further comprises:
a shaft extending along the axis, with an outer perimeter;
a slide slot at the outer perimeter of the shaft; and
a locking mechanism coupled to the slide slot;
wherein:
the inner perimeter of the bore of the first portion is complementary to the outer perimeter of the shaft of the second portion to guide the second portion along the axis;
the stub of the first portion is coupled to the slide slot of the second portion;
and
the locking mechanism of the second portion latches the stub of the first portion to inhibit the support section from moving further away from the base section.

15. The golf tee of claim 1, wherein:
the first section of the first portion further comprises:
a rod extending along the axis, with a rod outer perimeter; and
a tip, with a tip outer perimeter, at an end of the rod;
and
the second section of the second portion further comprises:
a bore extending along the axis, with a bore inner perimeter; and
a lip narrowing the bore inner perimeter to a lip inner perimeter;
wherein:
the tip outer perimeter is greater than the rod outer perimeter;
the bore inner perimeter of the second portion is complementary to the tip outer perimeter of the first portion; and
the lip inner perimeter is complementary to the rod outer perimeter of the first portion.

16. A golf tee to support a golf ball, comprising:
a first portion;
a second portion coupled to the first portion;
an axis along the first and second portions; and
a compressible material located between the first portion and the second portion;
wherein:
the golf tee comprises:
a compressed configuration when the golf tee is subjected to a load; and
a relaxed configuration when the load is removed;
the first portion comprises:
a base section to support the golf tee; and
a first section opposite the base section;
the second portion comprises:
a support section to support the golf ball;
a second section opposite the support section; and
a perimeter of an end of the support section defining a plane;

the second section of the second portion is coupled to the first section of the first portion;

the axis is substantially perpendicular to the plane;

the first and second portions are displaceable, relative to each other, along the axis;

the golf tee is transitioned from the relaxed configuration to the compressed configuration when the load moves the second portion towards the first portion;

the compressible material is configured to:

increasingly compress along the axis as the golf tee is transitioned from the relaxed configuration to the compressed configuration; and automatically return the golf tee to the relaxed configuration when the load is removed;

the first section of the first portion comprises:

a first section outer perimeter;

a rod extending along the axis, with a rod outer perimeter; and a tip, with a tip outer perimeter, at an end of the rod;

the second section of the second portion comprises:

a bore extending along the axis, with a bore inner perimeter; and a lip narrowing the bore inner perimeter to a lip inner perimeter;

the tip outer perimeter is greater than the rod outer perimeter;

the first section outer perimeter is greater than the rod outer perimeter;

the bore inner perimeter is complementary to the first section outer perimeter; and the lip inner perimeter is complementary to the rod outer perimeter of the first portion.

17. The golf tee of claim 1, wherein:

the first section further comprises a first magnet;

the second section further comprises a second magnet; and the first magnet and the second magnet are oriented to repel each other.

18. A method of manufacture for a golf tee, the method comprising:

providing a first portion comprising:

a base section with a ground-piercing end to support the golf tee; and a first section opposite the base section;

providing a second portion complementary to the first portion and comprising:

a support section to support a golf ball; and a second section opposite the support section and configured to couple with the first section of the first portion;

providing a compressible medium; and coupling together the first portion and the second portion such that:

the compressible medium is coupled between the first and second portions; and the first and second portions are substantially non-tiltable relative to each other;

wherein:

a perimeter of a support end of the support section defines a plane;

the second portion is substantially displaceable, relative to the first portion, along a longitudinal axis of the golf tee;

while the second portion displaces relative to the first portion, the plane remains substantially perpendicular to the longitudinal axis of the golf tee; and the compressible material is configured to:

increasingly compress between the first and second portions, and along the longitudinal axis, to transition the golf tee to a compressed configuration when the golf tee is subjected to a load; and automatically decompress between the first and second portions, and along the longitudinal axis, to transition the golf tee from the compressed configuration to a relaxed configuration when the load is removed from the support end of the support section and while the base section of the first portion remains inserted into a ground surface.

19. The method of claim 18, further comprising:

providing a restrictor mechanism at at least one of the first or second portions to restrict a separation of the first and second portions from each other;

wherein:

the first and second portions are substantially concentric to the longitudinal axis; and the restrictor mechanism comprises at least one of:

a stub, a bracket, a slot, a tab, or a lip.

20. The golf tee of claim 1, wherein:

the compressible material is located within an internal cavity of the golf tee; and the load comprises a compressive load at a top end of the support section and directed towards the base section.

21. The golf tee of claim 1, wherein:

the second section of the second portion further comprises a bore extending along the axis;

an outermost perimeter of the bore of the second section is configured to slidably engage an exterior perimeter of the first section of the first portion.

22. The golf tee of claim 1, wherein:

the first and second portions are configured to remain coupled together; and the compressible material remains, from end to end thereof, between opposite longitudinal ends of the second portion.

23. A method of manufacture for a golf tee, the method comprising:

providing a first portion comprising:

a base section with a ground-piercing end to support the golf tee; and a first section opposite the base section;

providing a second portion complementary to the first portion and comprising:

a support section to support a golf ball; and a second section opposite the support section and configured to couple with the first section of the first portion;

providing a compressible medium; and coupling together the first portion and the second portion such that:

the compressible medium is coupled between the first and second portions; and the first and second portions are substantially non-tiltable relative to each other;

wherein:

a perimeter of a support end of the support section defines a plane;

the second portion is substantially displaceable, relative to the first portion, along a longitudinal axis of the golf tee;

while the second portion displaces relative to the first portion, the plane remains substantially perpendicular to the longitudinal axis of the golf tee; and the compressible material is configured to:
increasingly compress between the first and second portions, and along the longitudinal axis, to transition the golf tee to a compressed configuration when the golf tee is subjected to a load; and
automatically decompress between the first and second portions, and along the longitudinal axis, to transition the golf tee from the compressed configuration to a relaxed configuration when the load is removed from the support end of the support section;
the first section of the first portion comprises:
a first section outer perimeter;
a rod extending along the longitudinal axis, with a rod outer perimeter; and
a tip, with a tip outer perimeter, at an end of the rod;
the second section of the second portion comprises:
a bore extending along the axis, with a bore inner perimeter; and
a lip narrowing the bore inner perimeter to a lip inner perimeter;
the tip outer perimeter is greater than the rod outer perimeter;
the first section outer perimeter is greater than the rod outer perimeter;
the bore inner perimeter is complementary to the first section outer perimeter; and
the lip inner perimeter is complementary to the rod outer perimeter of the first portion.

24. The method of claim 18, wherein:
the compressible medium is configured to:
remain located within an internal cavity of the golf tee.

25. The method of claim 18, wherein:
the first portion or the second portion comprises at least one of:
a metallic material, a wooden material, a nylon material, or a polypropylene material; and
the compressible medium comprises at least one of:
a spring, a foam cushion, a urethane cushion, a sponge, a soft plastic, a magnetic mechanism, a body of air, or a gaseous cushion.

26. The method of claim 18, wherein:
the load comprises an expansion force exerted by the golf ball when deformed upon impact with a strike face of a club;
the compressible medium is configured to automatically maintain the support section of the golf tee at a first height when the golf tee supports a weight of the golf ball;
the second portion of the golf tee is configured to displace towards the first portion, such that the support section of the golf tee is at a second height, when the expansion force is exerted; and
the first height is greater than the second height.

27. The method of claim 18, further comprising:
providing a second compressible medium;
wherein:
the compressible medium comprises a first degree of compressibility;
the second compressible material comprises a second degree of compressibility; and
the compressible medium is interchangeable in the golf tee with the second compressible medium.

28. The method of claim 18, wherein:
the compressible medium is configured to prevent the golf tee from reaching a fully compressed configuration while the golf tee supports the load; and
the load comprises at least one of:
a weight of the golf ball; or
an expansion force exerted by the golf ball when deformed upon impact with a strike face of a club.

29. The method of claim 18, wherein:
the first section of the first portion further comprises:
a first tab; and
a bracket;
and
the second section of the second portion further comprises:
a first prong with a first wall;
a second prong with a second wall; and
a stub at the first prong;
wherein:
the first prong and the second prong extend substantially parallel to the longitudinal axis;
the first wall of the first prong and the second wall of the second prong are configured to straddle the first tab and guide the second portion along the axis; and
the stub of the first prong couples to the bracket of the first portion to inhibit the support section from moving further away from the base section.

30. The method of claim 18, wherein:
the first section of the first portion further comprises:
a shaft with an outer perimeter; and
a first stub at the outer perimeter of the shaft;
and
the second section of the second portion further comprises:
a wall with an inner perimeter;
a slide slot located at the inner perimeter of the wall; and
a locking mechanism coupled to the slide slot;
wherein:
the inner perimeter of the wall of the second portion is complementary to the outer perimeter of the shaft of the first portion to guide movement of the second portion along the longitudinal axis;
the first stub is configured to be engaged within the slide slot; and
the locking mechanism of the second portion is configured to latch the first stub of the first portion to inhibit the support section from moving further away from the base section.

31. The method of claim 30, wherein:
the locking mechanism comprises at least one of:
a tab forming part of the inner perimeter of the wall;
a retainer slot leading to the end of the slide slot.

32. The method of claim 18, wherein:
the first section of the first portion further comprises:
a bore extending along the longitudinal axis, with an inner perimeter; and
a stub at the inner perimeter of the first section;
and
the second section of the second portion further comprises:
a shaft extending along the longitudinal axis, with an outer perimeter;
a slide slot at the outer perimeter of the shaft; and
a locking mechanism coupled to the slide slot;
wherein:
the inner perimeter of the bore of the first portion is complementary to the outer perimeter of the shaft of the second portion to guide the second portion along the longitudinal axis;
the stub of the first portion is configured to be coupled to the slide slot of the second portion; and the locking mechanism of the second portion is configured to latch the stub of the first portion to inhibit the support section from moving further away from the base section.

33. The method of claim 18, wherein:

the first section of the first portion further comprises:

a rod extending along the longitudinal axis, with a rod outer perimeter; and a tip, with a tip outer perimeter, at an end of the rod;

the second section of the second portion further comprises:

a bore extending along the longitudinal axis, with a bore inner perimeter; and a lip narrowing the bore inner perimeter to a lip inner perimeter;

the tip outer perimeter is greater than the rod outer perimeter;

the bore inner perimeter of the second portion is complementary to the tip outer perimeter of the first portion; and the lip inner perimeter is complementary to the rod outer perimeter of the first portion.

34. The method of claim 18, wherein:

the first section of the first portion comprises:

a first section outer perimeter;

a rod extending along the longitudinal axis, with a rod outer perimeter; and a tip, with a tip outer perimeter, at an end of the rod;

the second section of the second portion comprises:

a bore extending along the longitudinal axis, with a bore inner perimeter; and a lip narrowing the bore inner perimeter to a lip inner perimeter;

the tip outer perimeter is greater than the rod outer perimeter;

the first section outer perimeter is greater than the rod outer perimeter;

the bore inner perimeter is complementary to the first section outer perimeter; and the lip inner perimeter is complementary to the rod outer perimeter of the first portion.

* * * * *